US007383908B2

(12) United States Patent
Tuli

(10) Patent No.: US 7,383,908 B2
(45) Date of Patent: Jun. 10, 2008

(54) MOTORIZED WALKING SHOES

(75) Inventor: Raja Tuli, 555 Rene Levesque West, Suite 1130, Montreal, Quebec (CA) H2Z 1B1

(73) Assignee: Raja Tuli, Montreal (CA)

( * ) Notice: Subject to any disclaimer, the term of this patent is extended or adjusted under 35 U.S.C. 154(b) by 260 days.

(21) Appl. No.: 10/688,813

(22) Filed: Oct. 20, 2003

(65) Prior Publication Data

US 2005/0082099 A1 Apr. 21, 2005

(51) Int. Cl.
*A63C 1/02* (2006.01)

(52) U.S. Cl. ..... 180/181; 280/844; 280/11.27

(58) Field of Classification Search ..... 180/180, 180/181; 280/844, 11.27, 11.28, 71.13, 7.14, 280/7.13

See application file for complete search history.

(56) References Cited

U.S. PATENT DOCUMENTS

| | | | | |
|---|---|---|---|---|
| 5,236,058 | A * | 8/1993 | Yamet et al. | 180/181 |
| 5,305,846 | A * | 4/1994 | Martin | 180/181 |
| 5,382,052 | A * | 1/1995 | Tarng | 280/844 |
| 5,390,958 | A * | 2/1995 | Soo | 280/844 |
| 5,580,096 | A * | 12/1996 | Freilich | 280/844 |
| 5,730,241 | A * | 3/1998 | Shyr et al. | 180/181 |
| 5,797,466 | A * | 8/1998 | Gendle | 180/181 |
| 5,882,018 | A * | 3/1999 | Petrosino | 280/7.13 |
| 5,934,706 | A * | 8/1999 | Yiu | 280/844 |
| 6,059,062 | A * | 5/2000 | Staelin et al. | 180/181 |
| 6,086,072 | A * | 7/2000 | Prus | 280/11.28 |
| 6,435,290 | B1 * | 8/2002 | Justus et al. | 180/9.1 |
| 6,736,412 | B1 * | 5/2004 | Krah | 280/11.224 |

FOREIGN PATENT DOCUMENTS

| | | | |
|---|---|---|---|
| CA | 2151210 | A1 | 12/1995 |
| CA | 2185633 | A1 | 3/1998 |
| CA | 2190415 | A1 | 5/1998 |
| CA | 2366815 | A1 | 10/2000 |
| CA | 2340269 | A1 | 9/2002 |
| DE | 29611481 | U1 | 11/1996 |
| JP | 3159670 | A | 7/1991 |
| JP | 3218779 | | 9/1991 |
| NL | 1010079 | C | 3/2000 |
| WO | WO 0187436 | A1 | 11/2001 |

OTHER PUBLICATIONS

International Search Report, PCT/CA2004/001841, Apr. 29, 2005, 7 pages.

* cited by examiner

*Primary Examiner*—Jeff Restifo
(74) *Attorney, Agent, or Firm*—Blakely, Sokoloff, Taylor & Zafman LLP

(57) ABSTRACT

The present invention aims to provide incremental automotive transportation to a person wearing a pair of identical motorized shoes. Each shoe houses in its sole an assembly of electrically powered set of wheels clasped over longitudinally by a conveyor from heel to toe. The assembly, skewed at an adjustable angle from the longitude towards the instep, is initially in an elevated no-contact position with an underlying surface. When lowered and switched on, the assembly operates and transports the shoe forward, which is in contact with the surface through it only. The assembly is designed to neutralize forces acting to disrupt its operation during walking while the sole is equipped to provide stability by absorbing impacts. Further, multiple assemblies can be housed in one sole wherein some of them can be tilted, twisted, reflexively twisted, recessed and all have electronic sensors. Additionally, all electro-mechanical operations can be remote and computer controlled.

55 Claims, 16 Drawing Sheets

9
13
41

16
13
17
Heel
Instep
Region 13
9
42
9

MOTORIZED WALKING SHOES

BACKGROUND OF THE INVENTION

The present invention relates to a field of powered footwear to transport a user. Powered footwear enabling travel or motion of a user has been generally limited to a concept of powered or motorized roller skates and in-line skates. Examples of such efforts in the field are U.S. Pat. No. 3,876,032, U.S. Pat. No. 4,508,187, U.S. Pat. No. 5,236,058, U.S. Pat. No. 5,797,466 and U.S. Pat. No. 6,059,062. All these efforts represent motion of a user of powered footwear wherein the natural mechanical walking action of a user is rendered useless or has a minimal contribution to the motion of the user through the powered footwear. The equipment is designed for fast sportier motion of the user. In addition, the powered footwear is bulked up with equipment such that the user may not be able to utilize a normal mechanical walking action along with the motorized footwear. The present invention is designed to supplement normal mechanical walking action of a user without affecting the walking action. The invention is designed to be user friendly and it functions by increasing the walking speed with ordinary daily walking in view.

BRIEF SUMMARY OF THE INVENTION

The present invention relates to a concept of automotive transportation of a person wearing a pair of electrically powered motorized shoes. The principal idea of the invention is to provide a range bound increment to a normal walking speed of a person as soles of the shoes make contact and then subsequently break that contact with an underlying surface in a course of a normal walking action. A sole housed motorized assembly and its operation does not affect normal walking action.

In a principal embodiment, the sole of the shoe, from the pair of shoes, houses an assembly of conveyor, protected by walls completely, clasped over a set of electrically powered wheels or rollers. The entire length of the conveyor assembly can be mechanically adjusted for a skew angle within the plane of the sole, within a given range, from a longitude that goes from heel to toe. This angle balances the outward angle that the longitude makes with the forward walking direction. In order to operate, the conveyor assembly is lowered from an elevated no-contact position, such that it becomes the only contact of the sole with the underlying surface.

When lowered and switched on, the conveyor transports the foot forward until it leaves contact with the underlying surface. In a forward walking action as one shoe makes contact with the surface, the other shoe begins to decrease its contact with the surface while bending in a crumple zone in the process and generating a torque. The conveyor is also designed to bend along the crumple zone and operate unaffectedly, with a user synchronized and preset speed for both shoes. As the shoe makes contact, it comes down with an angular force a component of which is acting downward in the heel area of the sole. Further, as the shoe leaves contact with the surface, the torque generated is acting in the toe area of the sole. Again, the conveyor is designed to operate unaffectedly as before while these forces, which can increase and reduce its speed, act upon it in the course of a normal walking action. The conveyor is also unaffected by the constant twists it is subjected to, in the heel area, by the impact of the surface on the sole while walking.

The sole of the shoe has a stabilizing mechanism in the heel area with at least two supports such that the impact of the underlying surface on the sole is absorbed during walking. In another embodiment, additional supports are located in middle and the toe area of the sole with the same function as before. All these supports are a mix of fixed, spring and shock absorbing types. Further, all supports are made to be lockable.

In another embodiment, the conveyor assembly is composed of two parallel parts. One part is in front of the crumple zone and the other is in the rear. This arrangement allows the conveyor to avoid bending at the crumple zone as well as limit the influence of front and rear forces acting upon the sole in the respective zones while walking. All other operational details are identical as in the principal embodiment. In another embodiment, there are multiple, parallel conveyor assemblies housed in one sole, separated by sidewalls, of the pair of shoes, with user preset and synchronized speed for all the conveyors. All the schematics of skew angle with the longitude from heel to toe, elevated and lowered positions in the sole as well as all operational and protective details apply identically as in the principal embodiment.

In another embodiment, with multiple conveyor assemblies housed in one sole, as before, the surface of the outer most assembly, farthest from the instep, is adjustably tilted for their entire length, at an angle from the plane of the sole, away from the instep. In another embodiment, with multiple assemblies in one sole, as before, the surfaces of the two outer most assemblies, farthest from the instep, are adjustably twisted, at an angle, which can be different for each surface, from the plane of the sole, away from the instep, in the heel area only. In the same embodiment, the conveyor closest to the instep is also twisted such that the conveyor surface in the toe area only is tilted at an angle from the plane of the sole towards the instep. In a similar embodiment, the same conveyors are not pre-twisted but are reflexively twisted in an identical manner as the previous embodiment as the shoe strikes the underlying surface and then leaves the surface.

In another embodiment, with multiple assemblies in one sole, the surfaces of the two outer most assemblies, farthest from the instep, are adjustably tilted for their entire length, at an angle, which can be different for each conveyor surface, from the plane of the sole, away from the instep. The tilt at the border assemblies provides a greater surface contact area for the conveyors as the foot strikes the underlying surface. In all embodiments with multiple assemblies, all the conveyors have a spring support directly connecting to the sole such that the spring support can only move in a linear direction perpendicular to the sole.

In another embodiment, with multiple conveyor assemblies, as before, the assemblies are of different lengths with different starting and ending points from heel to toe. In another embodiment with multiple conveyor assemblies, of different lengths the conveyor assemblies closest and farthest from the instep are recessed more towards the middle part of the sole than the central assemblies in the heel and toe sections of the sole. In another embodiment, all electrical and mechanical operations are handled remotely.

In another embodiment, the sole, housing the conveyor assemblies, is equipped with two sets of sensors connected to a computer. One set generates profiles of pressure patterns of the feet of the person walking while the other set measures the walking speed. With this system, data by the two sets of sensors fed to the computer on board the respective sole. The computer, with this information, deduces the intent of the walker and varies the speed of the conveyor assemblies synchronously with the conveyor assemblies on the other sole by wireless communication with the computer on the other sole. The wireless communication between the computers keeps the speed of conveyors on the both the soles synchronized at all times. In addition, the computer controls all electrical and mechanical operations.

DETAILED DESCRIPTION OF THE INVENTION

To facilitate description any numeral identifying an element in one figure will represent the same element in any other figure.

The present invention relates to a concept of motorized transportation of a person wearing a pair of shoes. The pair of shoes has identical devices constructed in their soles such that the person wearing them has an increment in normal walking speed, while the soles are in contact with an underlying surface, in a course of a normal walking action.

Figure 1A:
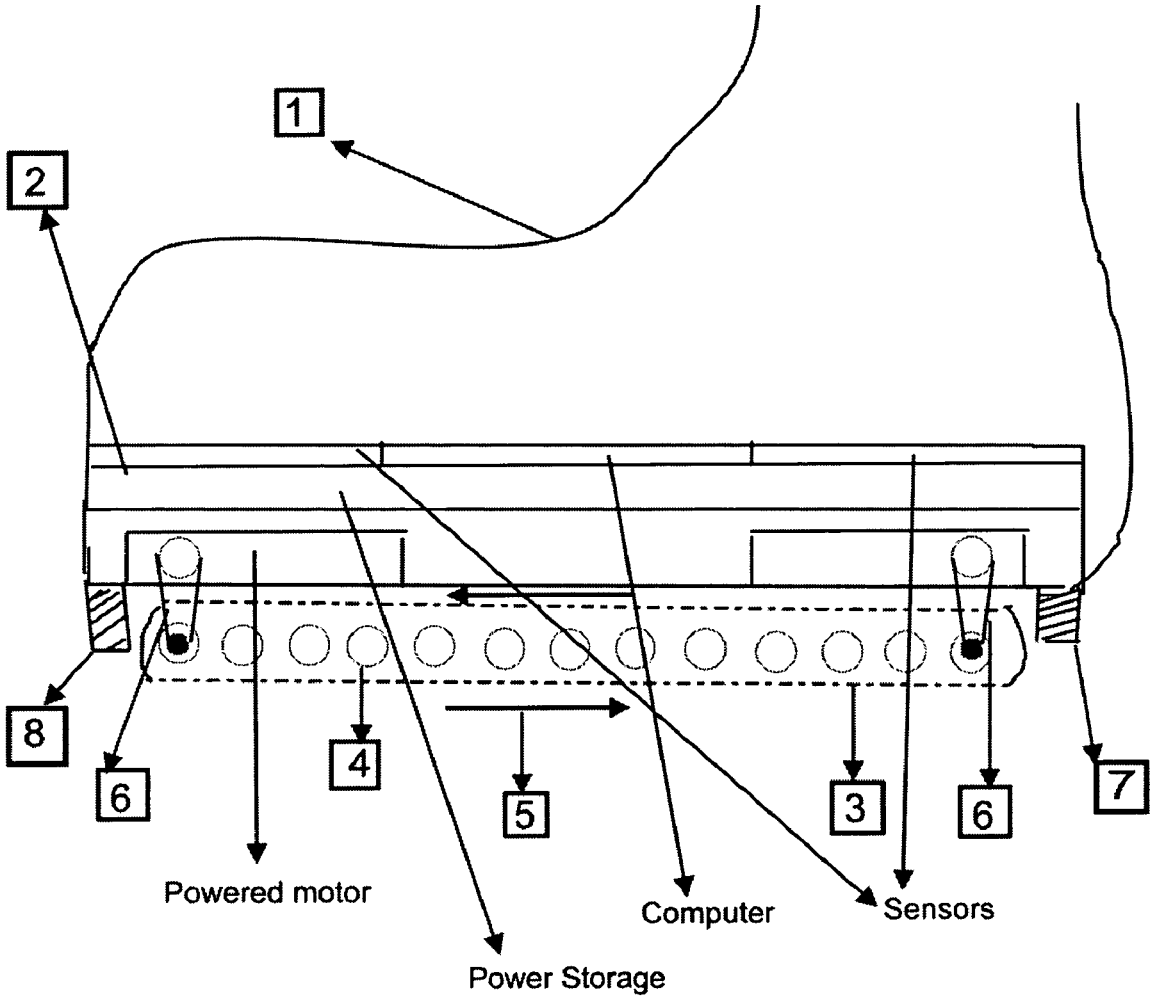
FIG. 1A illustrates a side view of a shoe in principal embodiment with mechanical assembly with conveyor in a lowered position.
Figure 1B:
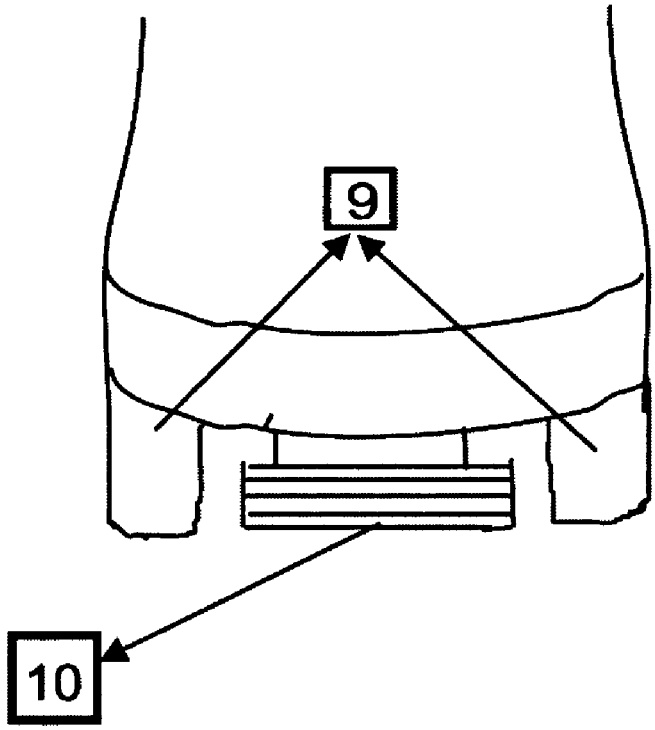
FIG. 1B illustrates a back view of heel section of a shoe in principal embodiment with mechanical assembly with conveyor in an elevated position.
Figure 1C:
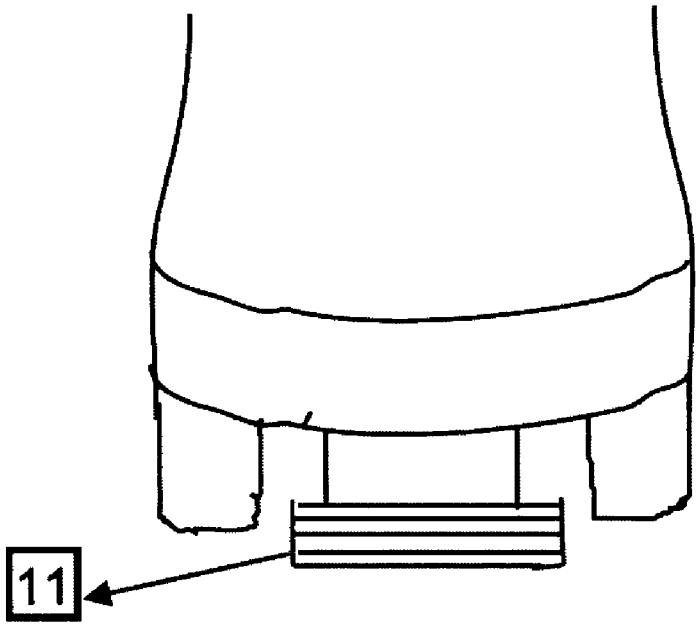
FIG. 1C illustrates a back view of heel section of a shoe in principal embodiment with mechanical assembly with conveyor in a lowered position.
Figure 2:
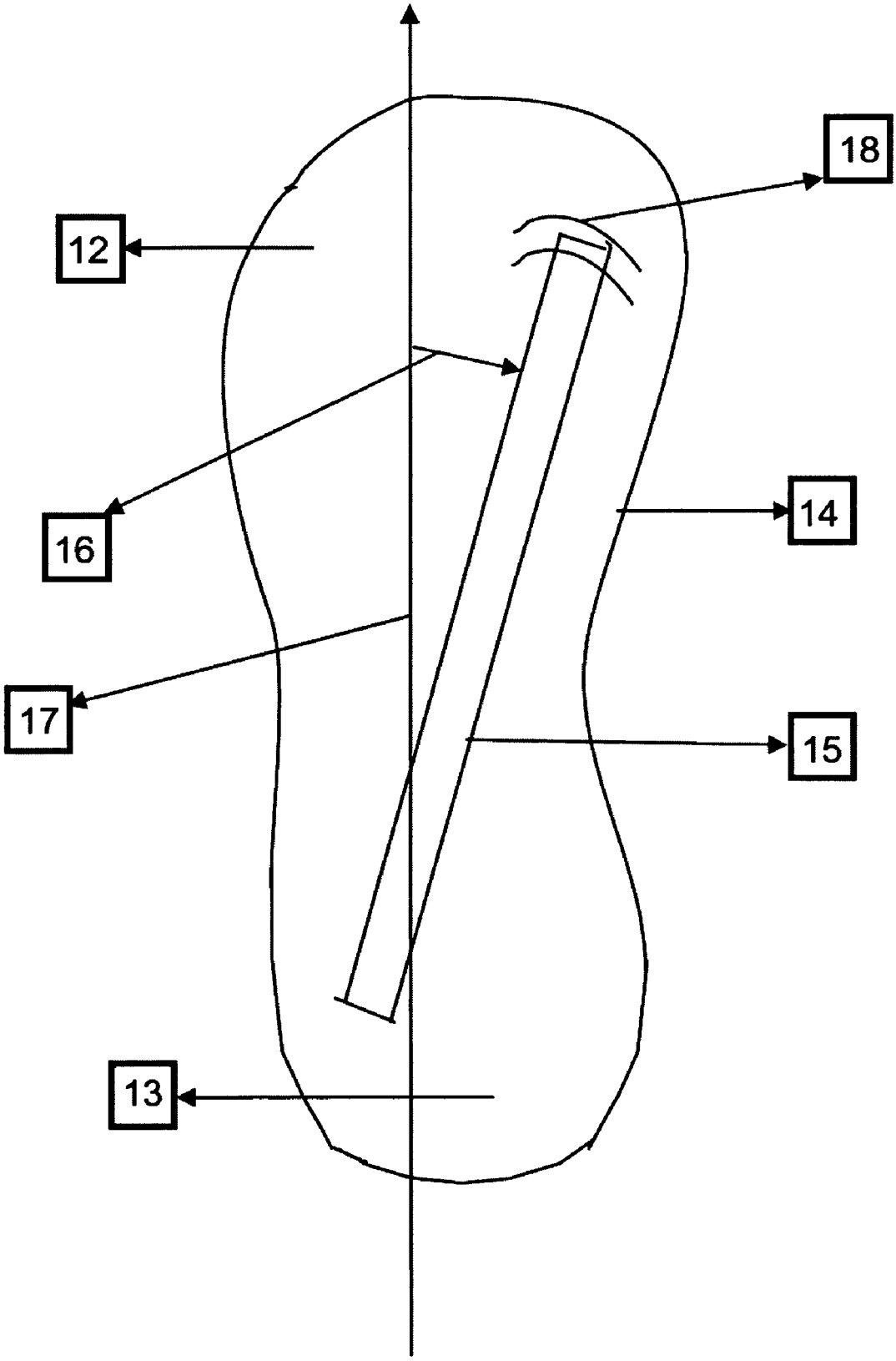
FIG. 2 illustrates a flat view of a sole of a shoe in principal embodiment with mechanical assembly making an angle with a line going from heel to toe.

In a principal embodiment of the invention, with reference to FIG. 1A, sole 2 of a shoe 1, from a pair of identical shoes, contains an assembly of a conveyor 3 wrapped over and clasping a set of wheels or rollers 4 and is covered on the sides by sidewalls 9, in FIG. 1B. The whole conveyor assembly can be elevated 10, in FIG. 1B and lowered 11, in FIG. 1C. While in an elevated position 10, the conveyor is not in contact with the underlying surface and the shoes can be utilized for normal walking. However, when lowered, the shoe with the lowered conveyor 11, in FIG. 1C, is in contact with the underlying surface through the conveyor only. An electrically powered motor drives some of the wheels or rollers 4, in FIG. 1A. In the same embodiment, with reference to FIG. 2 the whole assembly is built within the sole 2, in FIG. 1A, with the conveyor lined up in such a way that it is skewed with respect to a straight line going from heel section 13 to toe section 12, towards in side or instep 14 of the forward stepping direction. This skewing angle 16 is necessary to balance the outward angle, which the foot makes while walking, with respect to a straight line going in the forward stepping direction. As this outward angle differs from person to person, the skewing angle 16 is adjustable accordingly in the toe area 12 of the sole. The adjustment is made mechanically via a system in which a lever locks the position of the conveyor at a particular skewing angle within a limited adjustment room 18 provided. The conveyor assembly is covered by protective walls, like the side walls 9 in FIG. 1B, at the heel 7 and the toe 8, both in FIG. 1A. When the person wearing the pair of shoes walks forward 5, in FIG. 1A, and as one shoe with the lowered conveyor 11, in FIG. 1C, powered by the electric motor, comes in contact with the underlying surface, the conveyor transports that foot forward until it leaves contact with the underlying surface. In the same motion, while the sole on one shoe is starting to make contact with the underlying surface as in FIG. 3, the sole on the other shoe of the pair starts to decrease contact with the underlying surface as in FIG. 4. A user preset and synchronized increment of speed, for both shoes, due to the conveyor motion during the surface contact of the conveyor, is less than the normal walking speed and it does not disrupt the balance while walking. In addition, the increment in speed or the conveyor assembly itself, in either the elevated 10 or lowered 11 positions in FIGS. 1B and 1C, within the sole does not alter the normal walking action. The motorized action of the pair of shoes with conveyors assemblies housed in their soles works in conjunction with the normal walking action.

Figure 3:
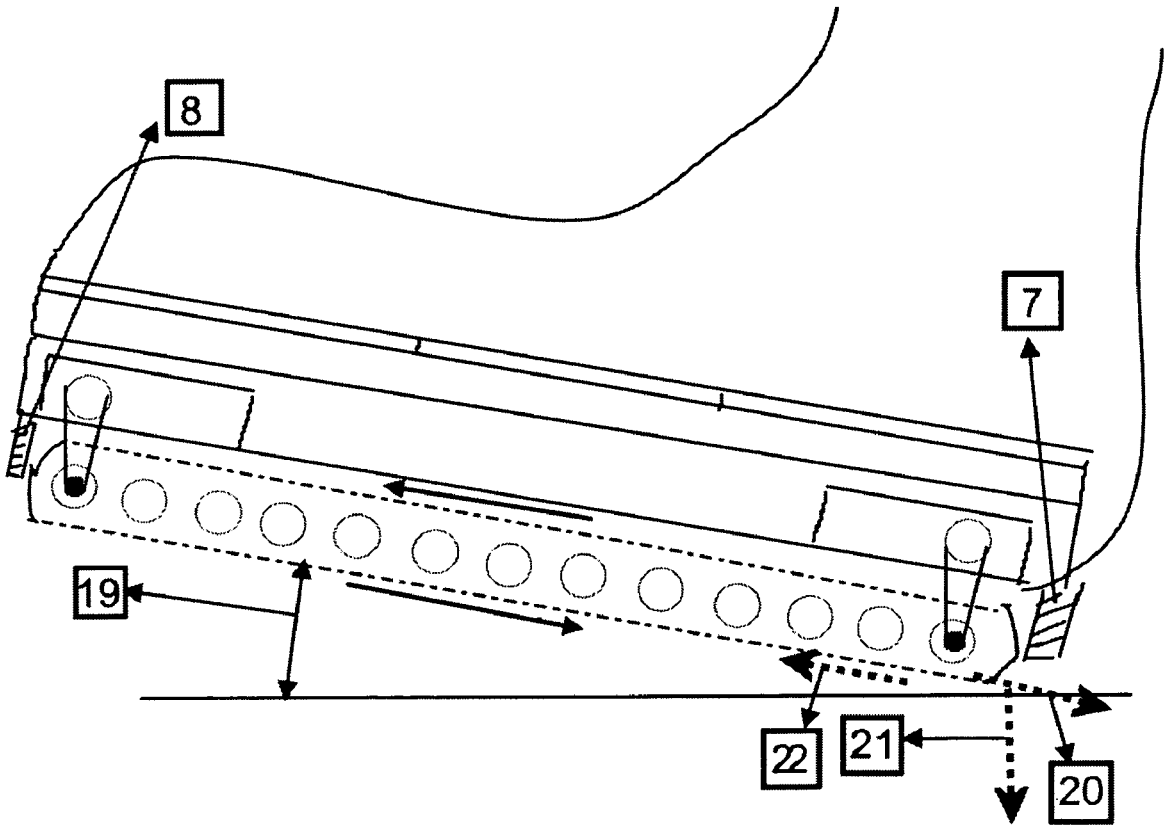
FIG. 3 illustrates a side view of a shoe in principal embodiment with mechanical assembly with conveyor making a contact with underlying surface at the heel section as the foot is put down in walking forward.

While in a forward walking stride, with reference to FIG. 3, as the sole of the shoe, with the conveyor assembly in a lowered position 11 as in FIG. 1*c*, first makes contact at the heel section, it is tilted forward at an angle 19 in form of a small incline. At this stage, there is a component of force 22 opposing the movement of the conveyor that is making an initial contact with the surface. This opposing component of force 22 is due to the angular downward motion of the foot, which exerts an angular force 20 and a downward force 21. This opposing force 22 therefore creates a backlash, to the conveyor movement for forward movement, possibly stalling the conveyor motion or altering the preset speed of the conveyor that is identical to the speed of the conveyor housed in other pair of the shoe. The conveyor assembly has a mechanism, which allows the conveyor to continue moving at the same preset speed in the same direction, despite the opposing force.

Figure 4:
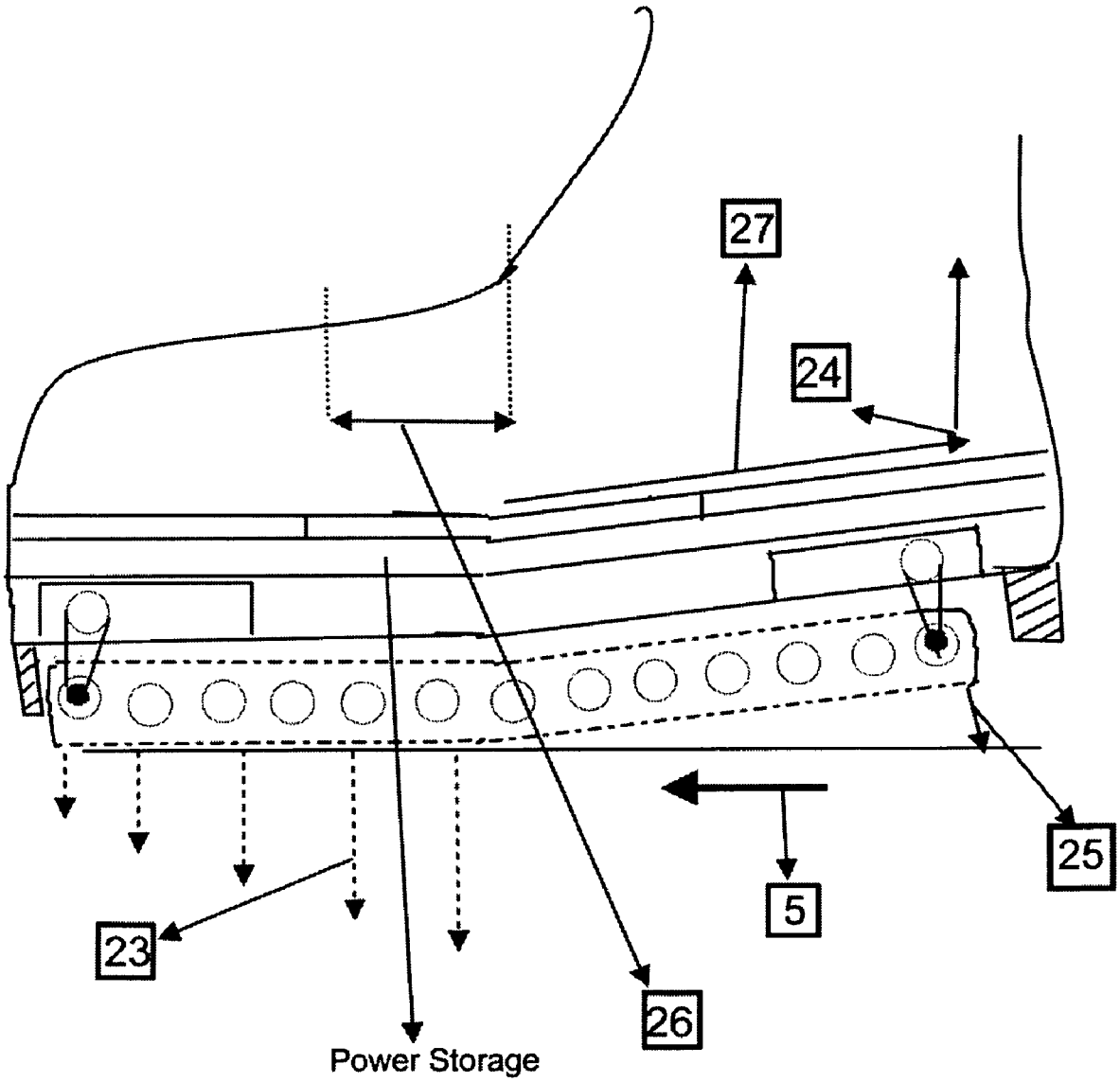
FIG. 4 illustrates a side view of a shoe in principal embodiment with mechanical assembly with conveyor beginning to decrease contact with underlying surface as the shoe lifts up while walking forward.
Figure 5:
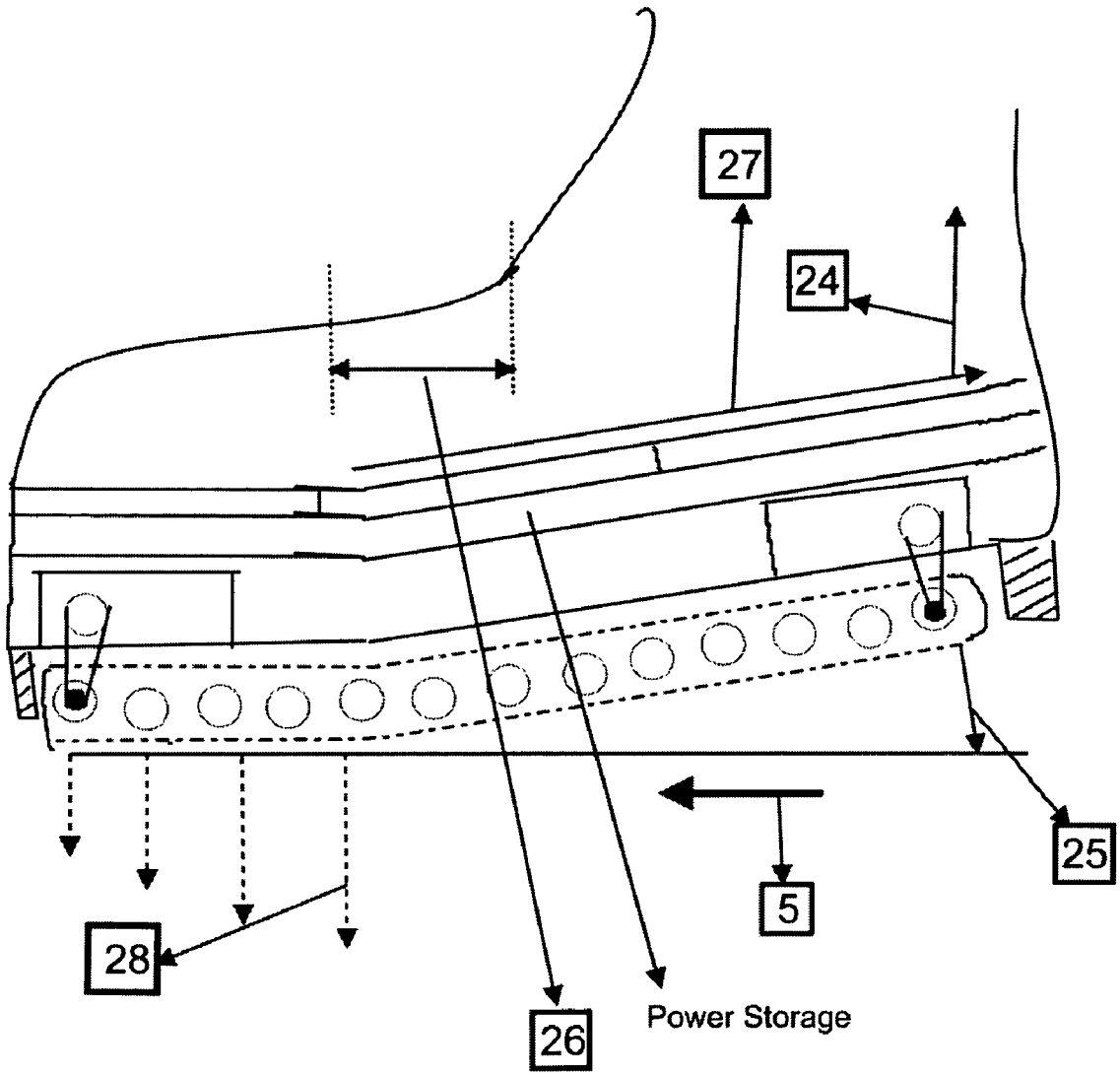
FIG. 5 illustrates a side view of a shoe in principal embodiment with mechanical assembly with conveyor further decreasing contact with underlying surface and bending in a crumple zone as the shoe lifts up while walking forward.
Figure 6:
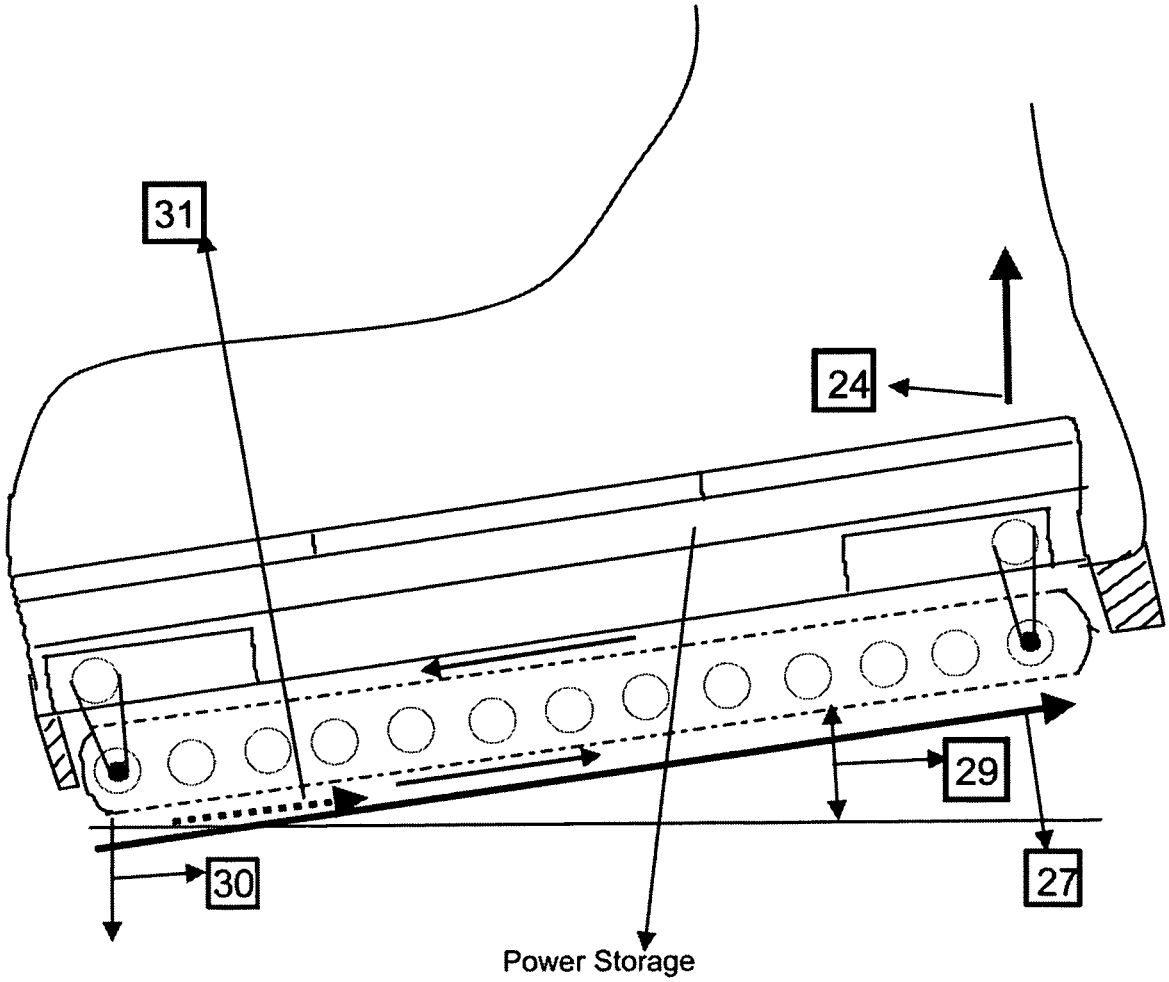
FIG. 6 illustrates a side view of a shoe in principal embodiment with mechanical assembly with conveyor just about to break contact with underlying surface as the shoe lifts up while walking forward.

Again, in the forward walking stride, with reference to FIGS. 4, 5 and 6, just as the sole of the shoe, with the conveyor in the lowered position 11 as in FIG. 1C, starts to lift in the air, there is an increased pressure downwards in an area, tending towards the toe section of the sole, which remains in contact with the underlying surface. The downward pressure or force is in a continuous sequence 23, in FIG. 4, such that it is greater in the beginning of the remaining contact of the sole with the surface and reduces towards the end of the toe section. This conveyor assembly is designed to operate continuously at a constant preset speed in presence of the downward pressure 23, in FIG. 4. As the shoe nears completing its lifting action, the region in the toe section in contact with the underlying surface decreases and with that the continuous sequence of force also shifts, compare FIGS. 4, 5 and 6, as such that the maximum force vector moves 28, in FIG. 5, towards the end of the toe area. The beginning part of the remaining contact of the sole with the surface, as the foot lifts up, is a crumple zone 26, in FIG. 4.

This crumple zone 26, in FIG. 4, is where the shoe bends, as it is lifts at the rear end of the heel section with a lifting force 24, in FIG. 4, and an increasing angle 25, in FIGS. 4 and 5, for a backward incline 29, in FIG. 6. When the shoe bends along the crumple zone 26, in FIGS. 4 and 5, in the forward walking action the conveyor also bends correspondingly within the crumple zone 26, in FIGS. 4 and 5. The conveyor assembly is designed to operate continuously without any disruption while it bends. The lifting force 24, in FIG. 5, and the shifting of force 28, in FIG. 5, towards the toe end of the shoe produces an increasing torque as the shoe lifts up. This torque reaches a maximum when the moment arm 27 is maximum in FIG. 6; just before the sole leaves contact with the underlying surface. The torque results in a component of force, which is a supplemental force 31, in FIG. 6, in the direction of the conveyor movement that can increase the speed of the conveyor. The supplemental force 31, in FIG. 6, starts from the time the shoe starts to lift until the moment it leaves contact with the underlying surface i.e. from the time when the torque is minimum till the time it reaches a maximum. The conveyor assembly has a mechanism to keep its speed constant despite the force 31, in FIG. 6, which tries to increase its speed.

Figure 7A:
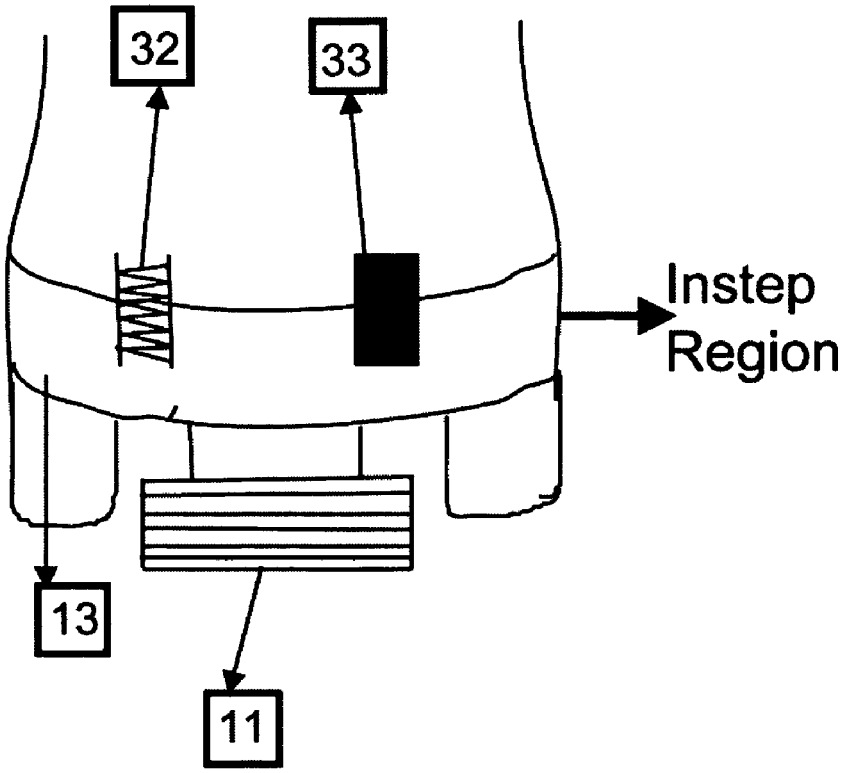
FIG. 7A illustrates a back view of heel section of a shoe in principal embodiment with mechanical assembly with conveyor in a lowered position and heel section having supports.
Figure 7B:
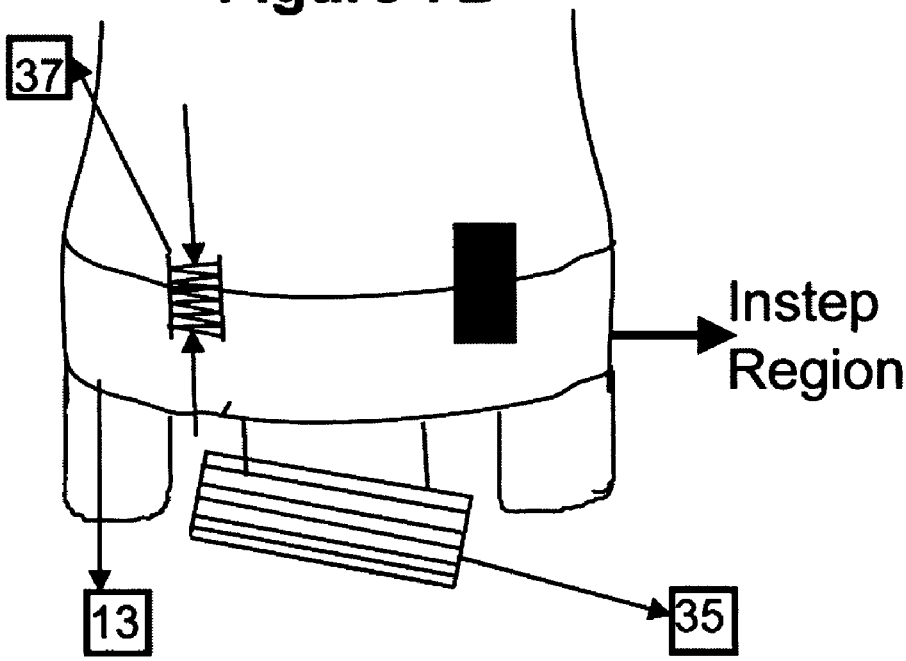
FIG. 7B illustrates a back view of heel section of a shoe in principal embodiment with conveyor surface tilting away from the instep region and corresponding support being compressed.
Figure 7C:
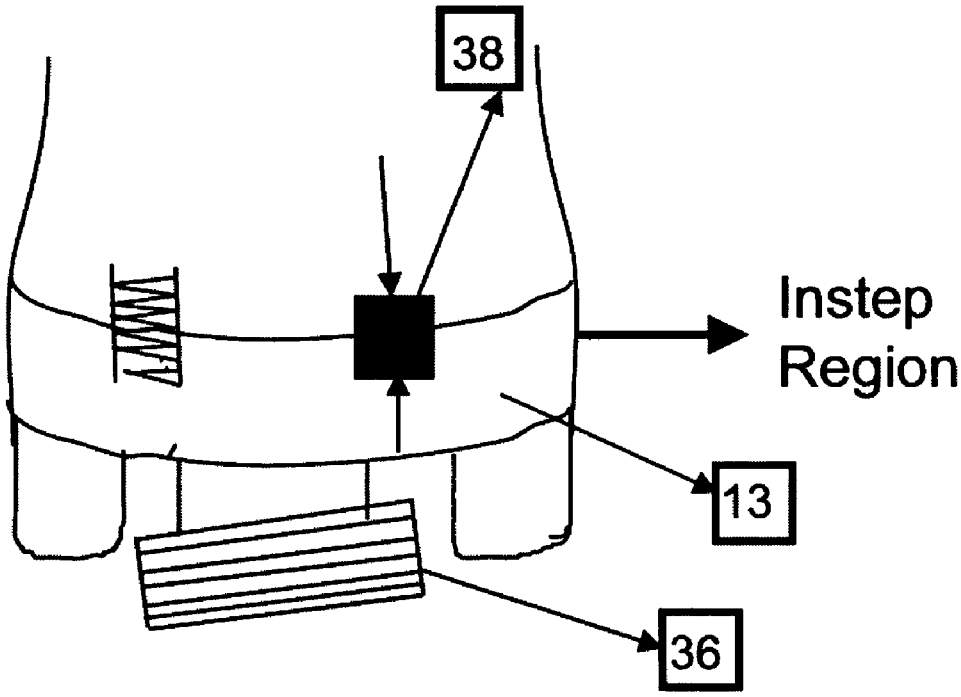
FIG. 7C illustrates a back view of heel section of a shoe in principal embodiment with conveyor surface tilting towards the instep region and corresponding support being compressed.
Figure 7D:
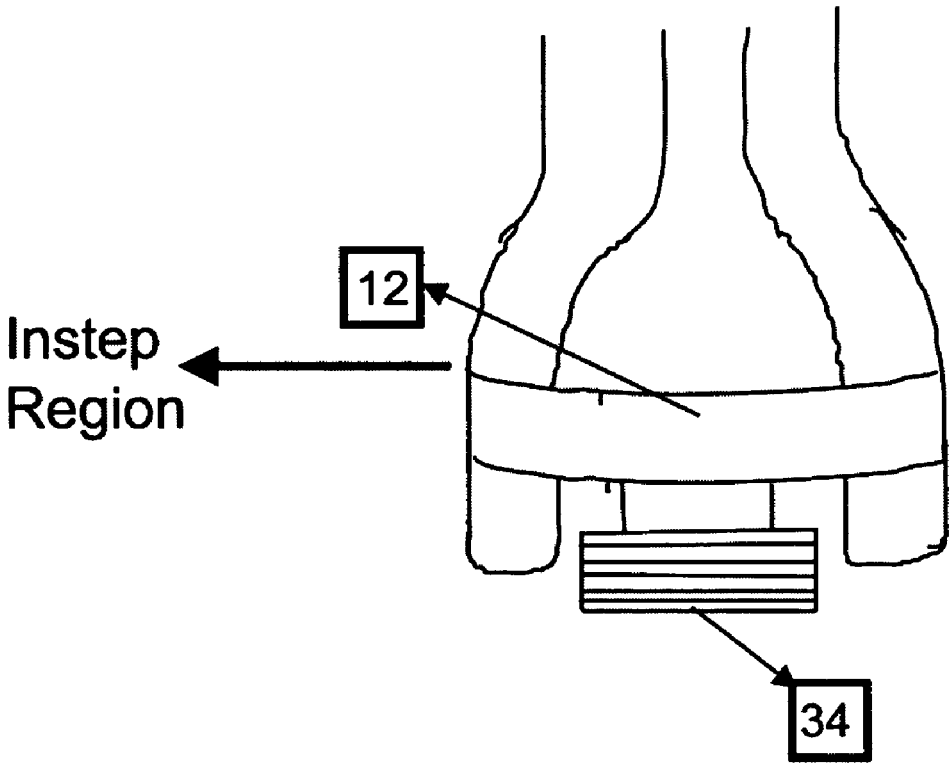
FIG. 7D illustrates a front view of toe section of a shoe in principal embodiment with conveyor surface parallel to underlying surface while the conveyor surface at the heel section is tilted.

The sole of the shoe, with reference to FIG. 7A, has a stabilizing mechanism in the heel area such that it absorbs the constant impacting of the foot at the heel area by the underlying surface while walking. The mechanism provides for at least two supports 32 and 33 in the heel section one of which may be fixed 33 at the instep. While walking, these supports recurrently contract due to the impact of the underlying surface on the heel area as the shoe strikes the underlying surface. The supports 32 and 33, in FIG. 7A, expand and revert to their original length once the weight is taken off. The pressure on the heel section, due to impact from the underlying surface while the shoe strikes the ground initially, causes the conveyor in the heel area to twist each time. This impact related twist implies that one of the supports 32 and 33, in FIG. 7A, is contracting more than the other causing the conveyor to tilt in the heel area such that the conveyor surface in the heel section is no longer parallel to the plane of the sole yet it is parallel to the underlying surface, while the conveyor surface is flat 34 in the toe section 12, in FIG. 7A. By getting twisted, the conveyor allows a greater surface area to be in contact with the underlying surface, than would be possible without a twisting action, as the foot initially strikes the surface. Further, this impact related twist could either be in the direction of the instep 36, in FIG. 7C, or in the direction opposite to instep 35, in FIG. 7B, depending upon which support 32 or 33, in FIG. 7A, is contracting more than the other. If the support contracting more than the other support is in the area opposite to the instep 37, in FIG. 7B, then the angle of the tilt for the conveyor surface will be away from the instep 35, in FIG. 7B. If the support contracting further than the other support, is toward the instep 38, in FIG. 7C, then the angle of the tilt for the conveyor surface will be towards instep 36, in FIG. 7C. The conveyor, while operating, is flexible to adjust to this impact related twist, which last for a very short period of time, and quickly reverts to its original position, without disrupting its operation, once the pressure causing the twist drops with the forward movement of the foot.

In another embodiment of the present invention, with reference to FIG. 7A, the supports 32 and 33 in the heel section are made with spring's 32 or shocks absorbers. Further, additional supports are located in the middle and toe sections of the sole. These additional supports, having the same functionality as the supports located in the heel region, in FIG. 7A, absorb the impact of the underlying surface on the sole while walking. Likewise, while walking, these additional supports recurrently contract due to the impact of the underlying surface on the sole. The supports expand and revert to their original length once the weight is taken off with the forward movement of the foot. These additional supports may comprise of fixed supports, springs or shock absorbers. Additionally, all supports located on the sole can be made lockable.

Figure 8:
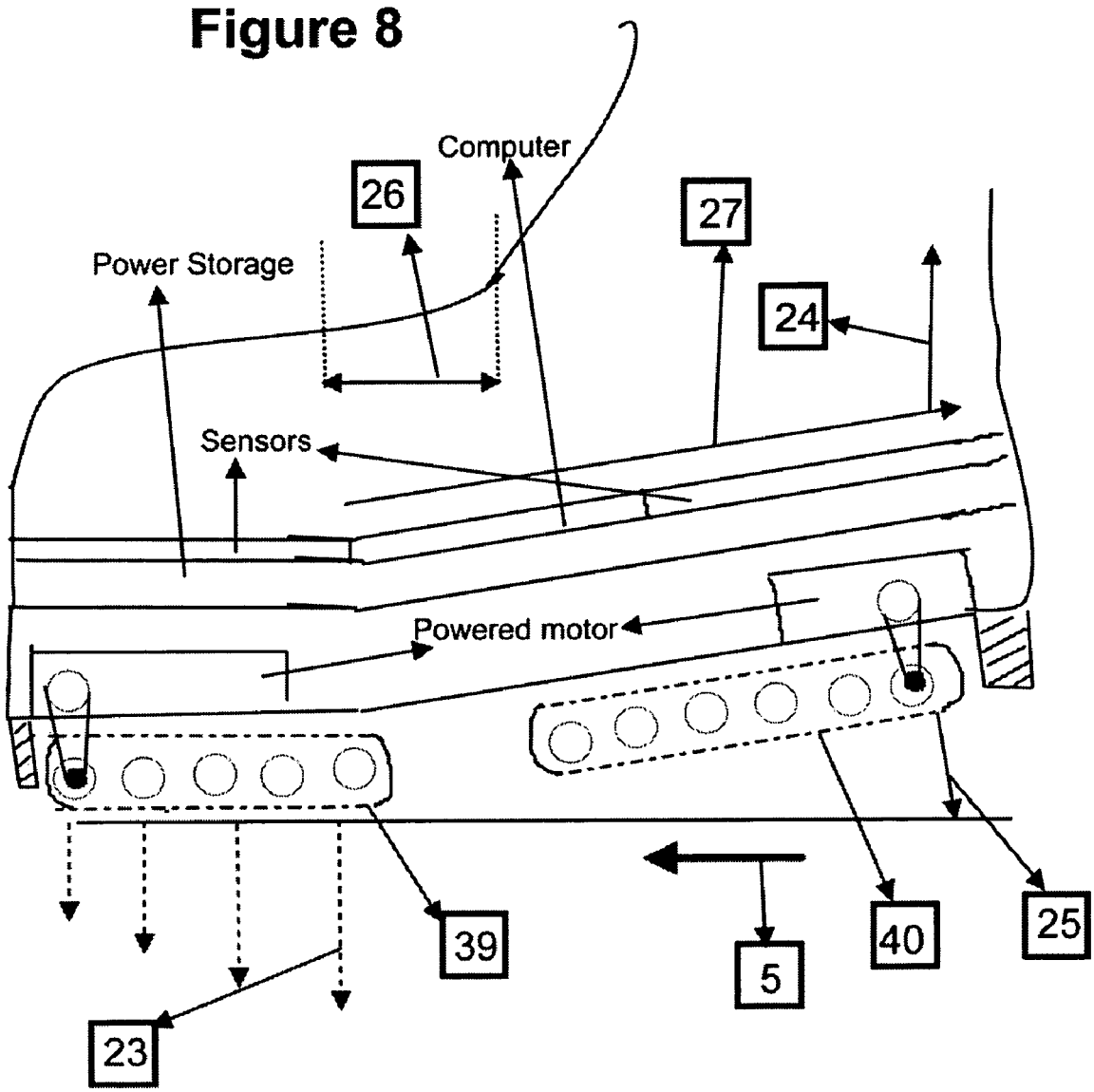
FIG. 8 illustrates a side view of a shoe in with two mechanical assemblies front ant rear with conveyors bending in a crumple zone as the shoe lifts up while walking forward.

In another embodiment of the present invention, with reference to FIG. 8, one conveyor assembly in a sole is in two parts such that the front conveyor 39 begins at the end of the crumple zone 26 and ends in the front end of the toe area. The rear conveyor 40 starts at the back end of the heel area and ends just before the beginning of crumple zone 26. In this configuration, both parts are parallel to each other while being skewed at the same angle 16 with respect to the straight line 17 going from heel to toe. In addition, like before, both parts are skewing adjustable for the skewing angle 16. This arrangement of conveyor allows the rear conveyor 40 to avoid being subjected to the supplemental force 31, in FIG. 6, as it disengages from the underlying surface quickly as the foot lifts up and bends at the crumple zone 26. Similarly, the front conveyor 39 is not subjected to the opposing force 22, FIG. 3, as the foot strikes down in an angular motion. Moreover, with this configuration, the conveyor assembly need not bend in the crumple zone 26 as the shoe bends.

Figures 9A, 9B, 9C:
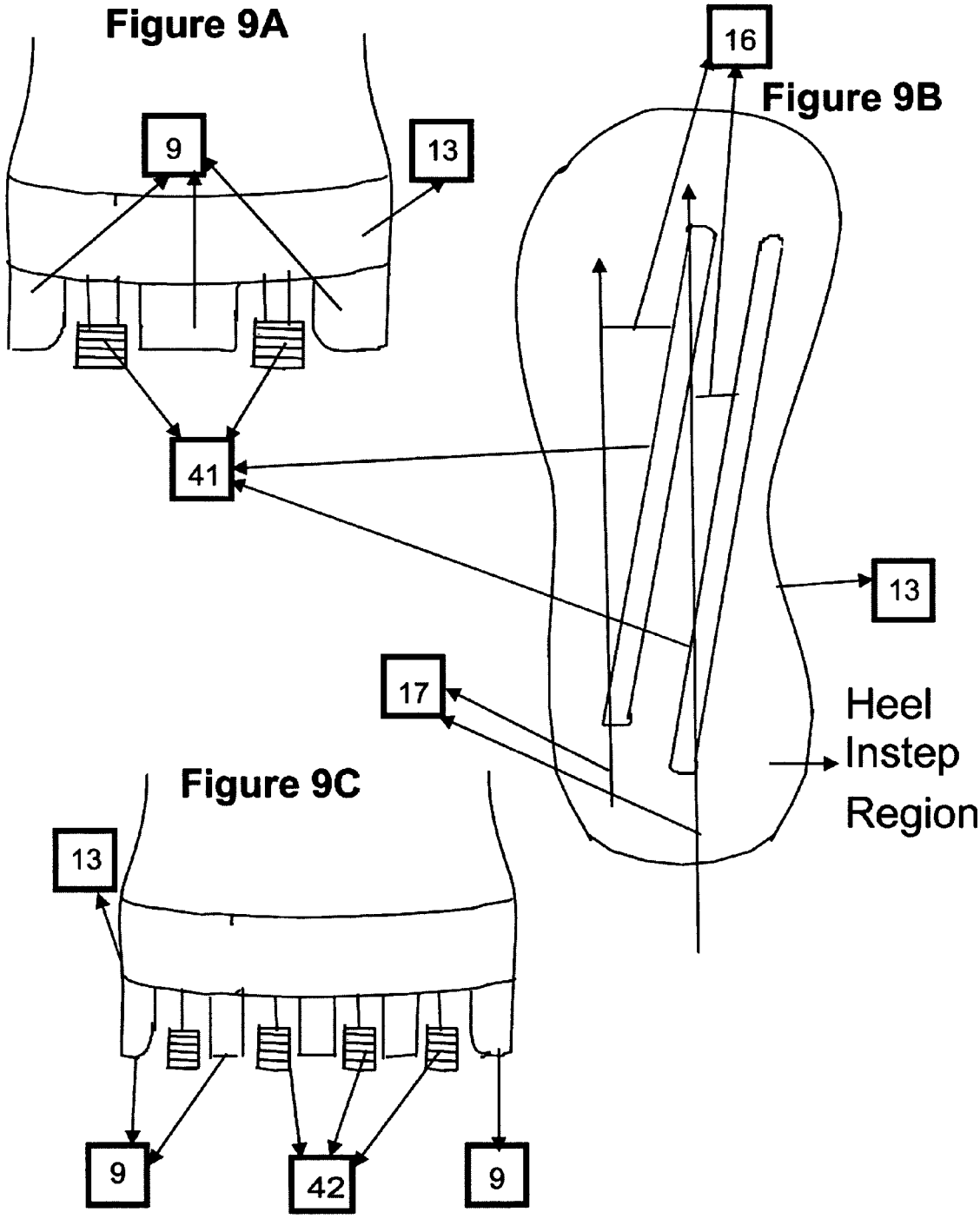
FIG. 9A illustrates a back view of heel section of a shoe with two mechanical assemblies with conveyors in a lowered position.
FIG. 9B illustrates a flat view of a sole of a shoe with two mechanical assemblies, each making an angle with a line going from heel to toe.
FIG. 9C illustrates a back view of heel section of a shoe with multiple mechanical assemblies with conveyors in a lowered position.

In another embodiment of the present invention, with respect to FIGS. 9A and 9C, there are two or more conveyor assemblies 41 and 42 housed in one sole of the shoe, from a pair of shoes. The multiple conveyor assemblies can be of equal or of different lengths within one sole. At all times these multiple assemblies in one sole are to be parallel to each other separated by sidewalls 9, in FIGS. 9A and 9C, and are skewed to the same angle 16, in FIG. 9B, with respect to the straight line 17, in FIG. 9B, going from heel to toe. The skew angle 16, in FIG. 9B, is adjustable, as in the principal embodiment, for all conveyors in the sole. In addition, as in the previous embodiment, the preset speed is the same for each of these multiple conveyors in the same direction, identical to the speed and direction of the conveyors, housed in the other shoe of the pair. Likewise, as in the principal embodiment of the present invention, all of the conveyor assemblies can be elevated and lowered.

Figure 10:
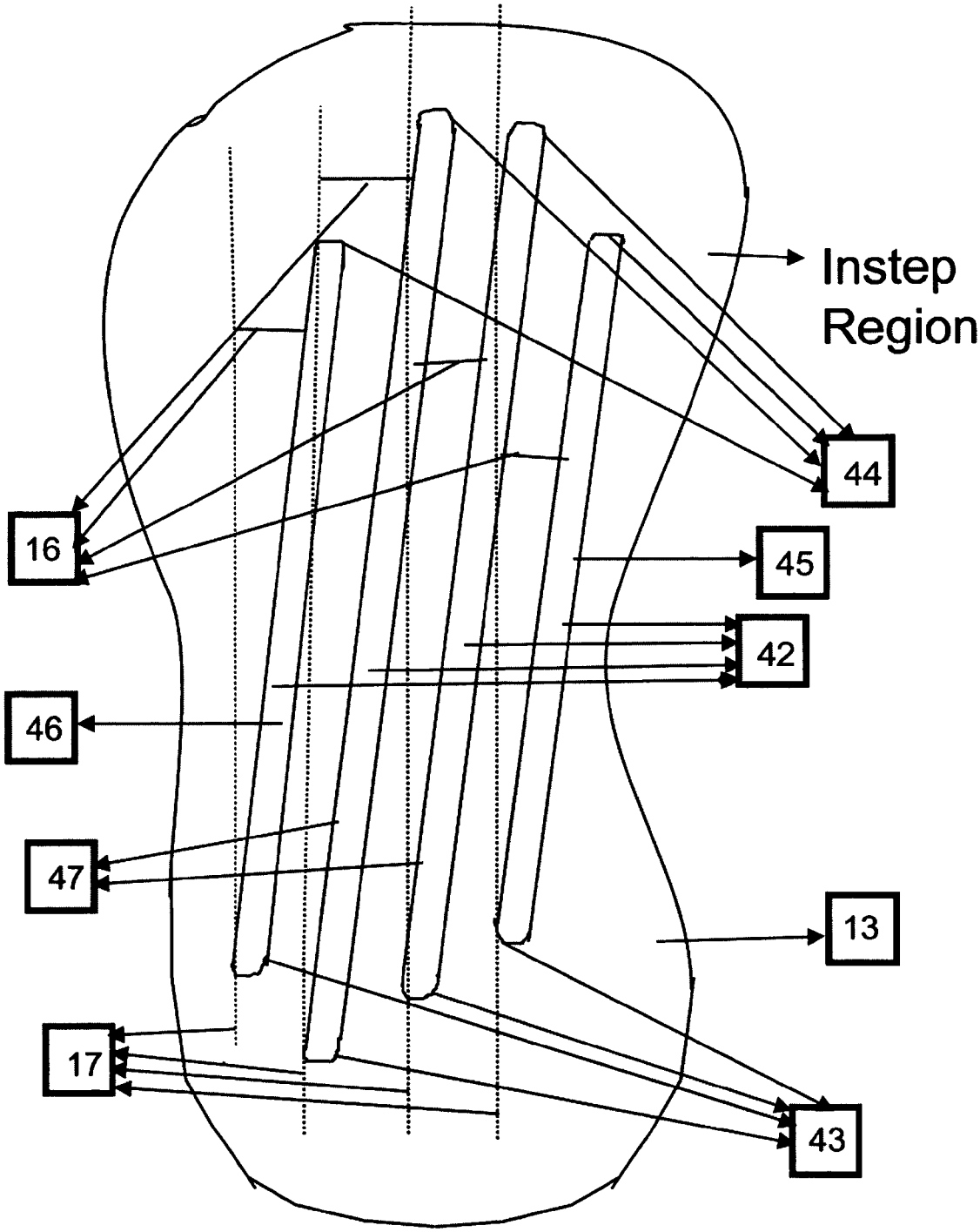
FIG. 10 illustrates a flat view of a sole of a shoe with multiple mechanical assemblies of unequal lengths, each making an angle with a line going from heel to toe.

In another embodiment of the present invention, with reference to FIG. 10, there are multiple conveyor assemblies 42 housed in one sole of the shoe. Each of the conveyor assemblies can be of different length, such that in the heel section each assembly has a different starting baseline 43. In addition, each conveyor assembly can have a different endpoint 44 in the toe section. Moreover, all conveyor assemblies are parallel to each other and skewed to the same angle 16 with respect to the straight line 17 going from heel to toe. All the conveyor assemblies are operable likewise as in the principal embodiment. In a separate embodiment of the present invention, with reference to FIG. 10, with multiple conveyor assemblies housed within one sole having unequal lengths, the assembly closest to the instep 45 and also the farthest 46 from the instep are shorter in length than the assemblies 47 in the central part of the sole. The baseline for the conveyor assembly 45 in the heel area is recessed away from the heel section towards the middle section of the sole compared to the central assemblies 47, which have their baseline in the heel section. Further, the endpoint of the conveyor assembly 46 is recessed away from the toe section toward the middle section of the sole. All the conveyor assemblies are operable likewise as in the principal embodiment.

In a further embodiment of the present invention, the conveyor assembly is an electronically motorized mechanical assembly that can be switched on and off via a remote switch. In addition, the adjustment to skewing angle 16, in FIG. 2, of the conveyor assembly is also remote adjustable. Further, the preset speed of the conveyors in the pair of shoes can be reset and synchronized by an electronic remote operation. Moreover, in all embodiments previous and subsequent, the elevation and lowering of conveyor assemblies can be performed mechanically as well as via an electronic remote switch.

Figure 11:
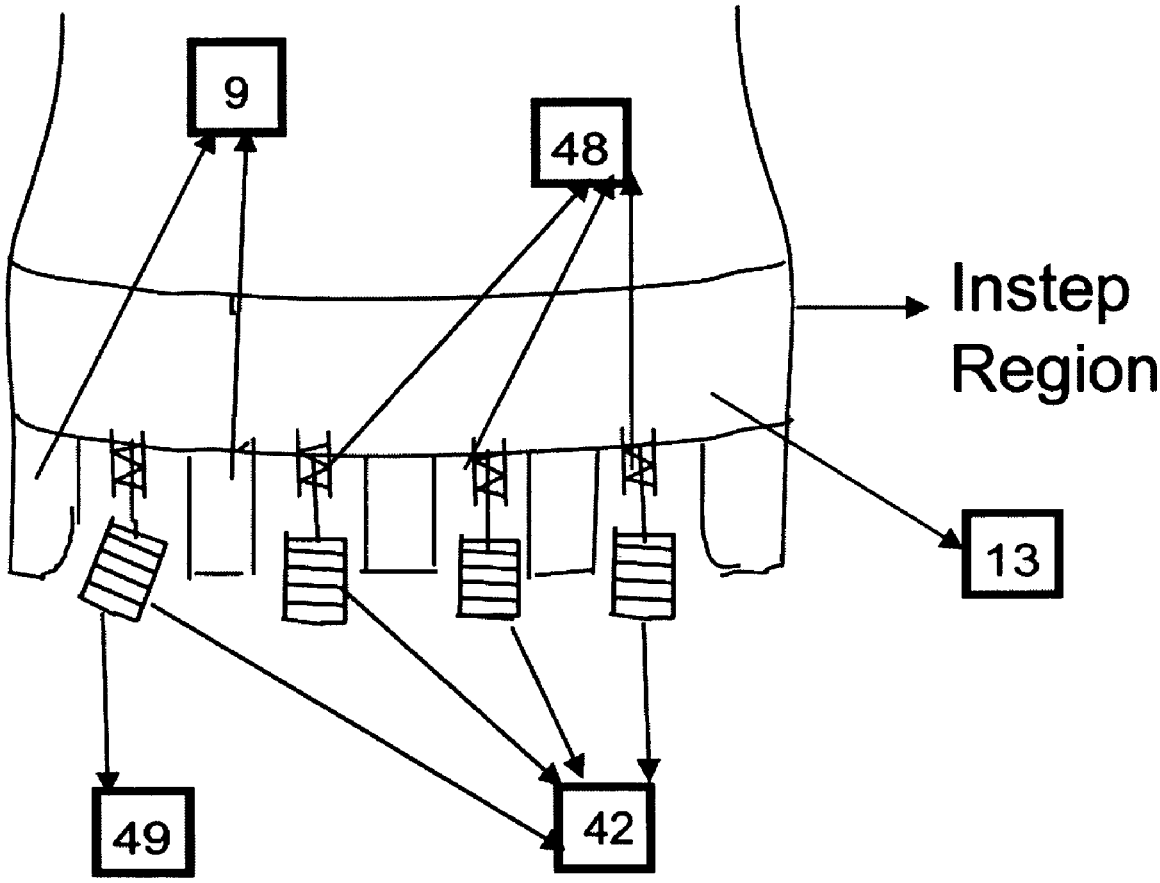
FIG. 11 illustrates a back view of heel section of a shoe with multiple mechanical assemblies with conveyors in a lowered position, along with spring supports to the sole, with the farthest assembly from the instep tilting away from the instep.

In another embodiment of the present invention, with reference to FIG. 11, there are multiple conveyors assemblies 42 housed in one sole separated by sidewalls 9. Further, all conveyor assemblies within the sole have a spring support 48 connected directly to the sole. The spring supports 48 move only in a linear direction perpendicular to the sole. The outer most conveyor assembly, farthest from the instep, is tilted 49 in its entire length, at an angle, away from the instep with respect to the sole. This angle of the tilt is adjustable. The tilted conveyor 49, when lowered with other conveyors in the same sole, as previously, comes into contact with the underlying surface. In the forward walking action as the sole of the shoe initially strikes the underlying surface at an angle, the area of the heel section opposite to the instep has a greater surface contact area with the underlying surface than the area at the instep. The angle of the tilted conveyor 49 is closer to the angle at which the heel section initially meets the underlying surface. This implies that the tilted conveyor 49 provides a greater possible contact area for the conveyor surface with the underlying surface than a conveyor surface that is parallel to the sole. When in contact with the underlying surface the tilted conveyor 49 contributes to the forward transportation of the foot along with all other conveyors 42 housed in the same sole. Further, the spring supports 48 of the conveyors compress linearly and absorbs some of the impact of the underlying surface on the sole. The spring supports 48 decompress once the foot moves forward in the forward walking action.

Figure 12A:
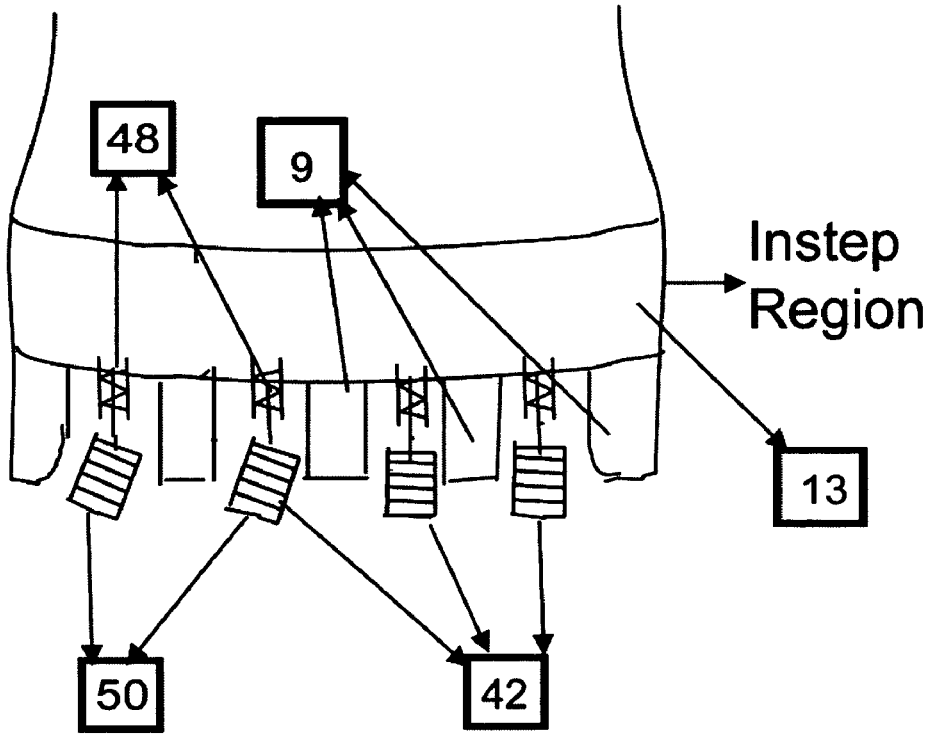
FIG. 12A illustrates a back view of heel section of a shoe with multiple mechanical assemblies with conveyors in a lowered position, along with spring supports to the sole, with the two farthest assemblies from the instep tilting away from the instep at same angle.
Figure 12B:
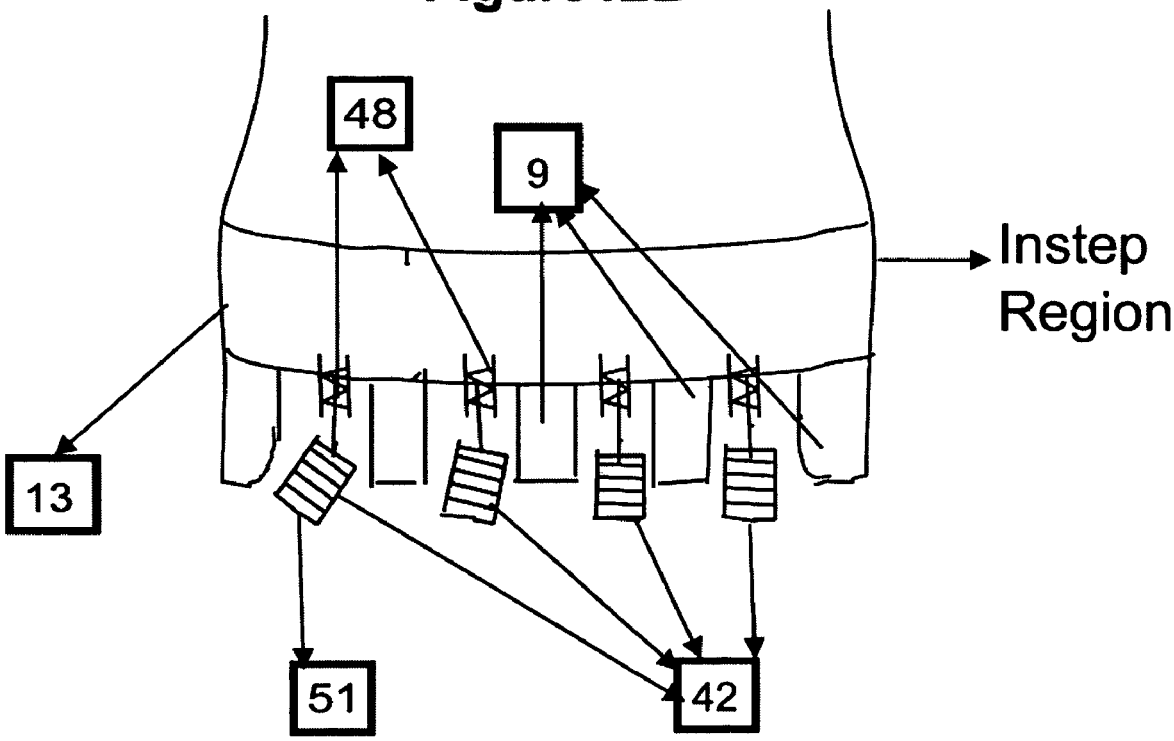
FIG. 12B illustrates a back view of heel section of a shoe with multiple mechanical assemblies with conveyors in a lowered position, along with spring supports to the sole, with the two farthest assemblies from the instep tilting away from the instep at different angles.

In another embodiment of the present invention, with reference to FIGS. 12A and 12B, there are multiple assemblies of conveyor 42 housed in one sole separated by sidewalls 9. Further, all conveyor assemblies within the sole have a spring support 48 connected directly to the sole. The spring supports 48 moves only in a linear direction perpendicular to the sole. The two outer most conveyors 50, in FIG. 12A, farthest from the instep, are tilted at a same angle, along their entire length, away from the instep with respect to the plane of the sole. This tilt of the two outer most conveyors 50, in FIG. 12A, which are away from the instep, allows for a greater contact at the heel section of the conveyor with the underlying surface as the angle of the tilted conveyors 50, in FIG. 12A, is closer to the angle at which the heel area initially strikes the ground. Again, this particular tilt of the outer most conveyor assemblies 50, in FIG. 12A, is adjustable mechanically as well as by electronic remote operation. The angle of the tilt for the two outer most conveyors 50, in FIG. 12A, can be such that they each have a different angle of the tilt, with the outer most conveyor having the greater angle 51, in FIG. 12B. The two different angles for the conveyors, with the greater angle 51, in FIG. 12B, at the outer most conveyor, provides for greater conveyor surface contact with the underlying surface than is possible if the two outer most conveyors have the same angle for the tilt as the heel section initially strikes the underlying surface. Further, the spring supports 48, in FIGS.

12A and 12B, of the conveyors compress linearly and absorbs some of the impact of the underlying surface on the sole. The spring supports 48, in FIGS. 12A and 12B, decompress once the foot moves forward in the forward walking action.

Figure 13A:
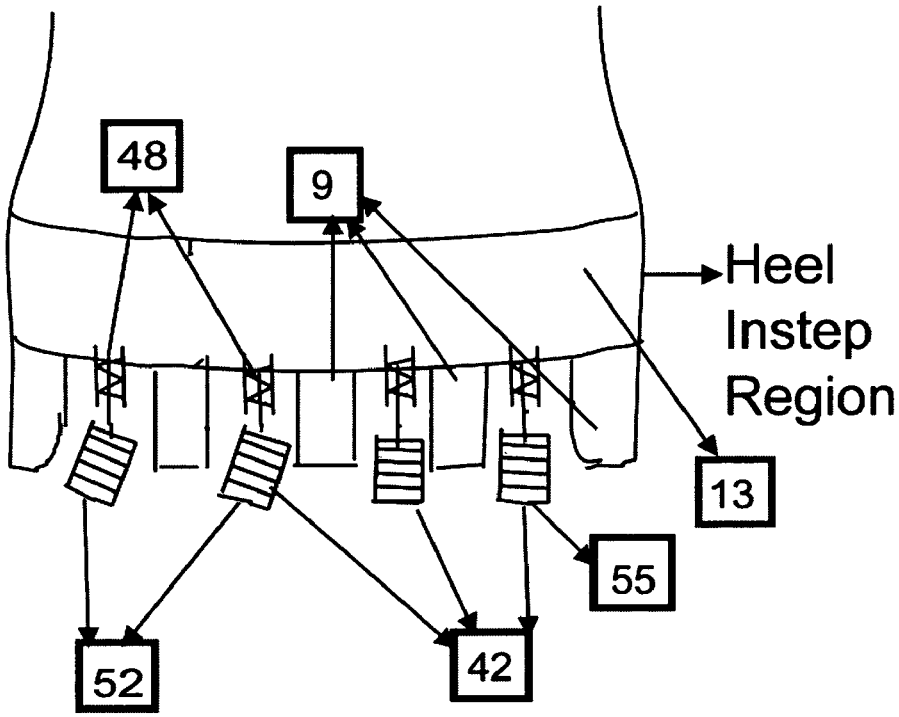
FIG. 13A illustrates a back view of heel section of a shoe with multiple mechanical assemblies with conveyors in a lowered position, along with spring supports to the sole, with only the two farthest assemblies from the instep being twisted by tilting away from the instep at same angle in the heel section.
Figure 13B:
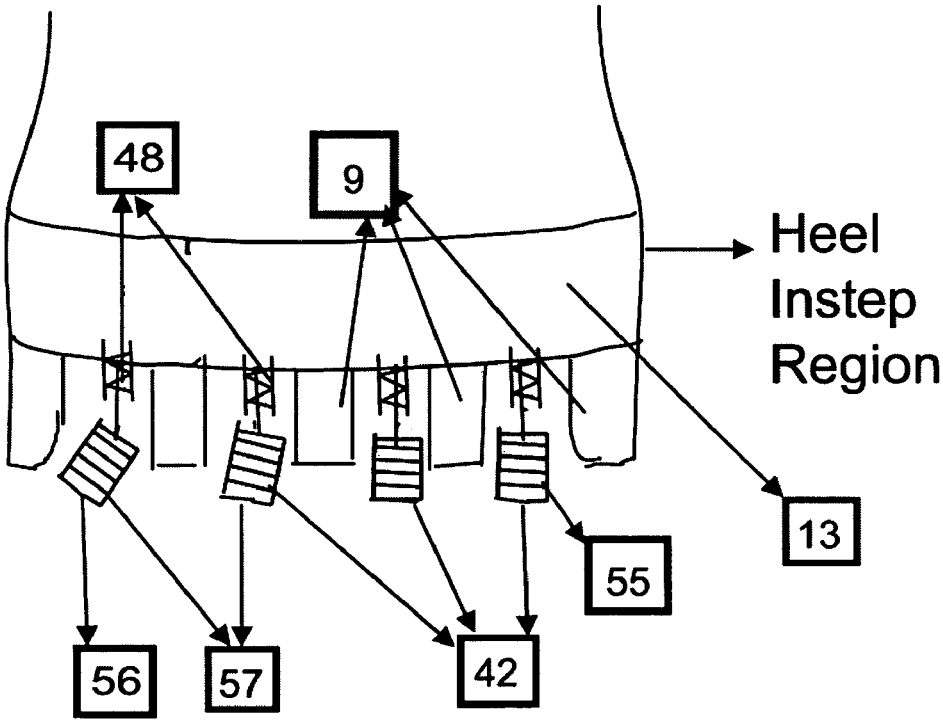
FIG. 13B illustrates a back view of heel section of a shoe with multiple mechanical assemblies with conveyors in a lowered position, along with spring supports to the sole, with only the two farthest assemblies from the instep being twisted by tilting away from the instep at different angles in the heel section.
Figure 13C:
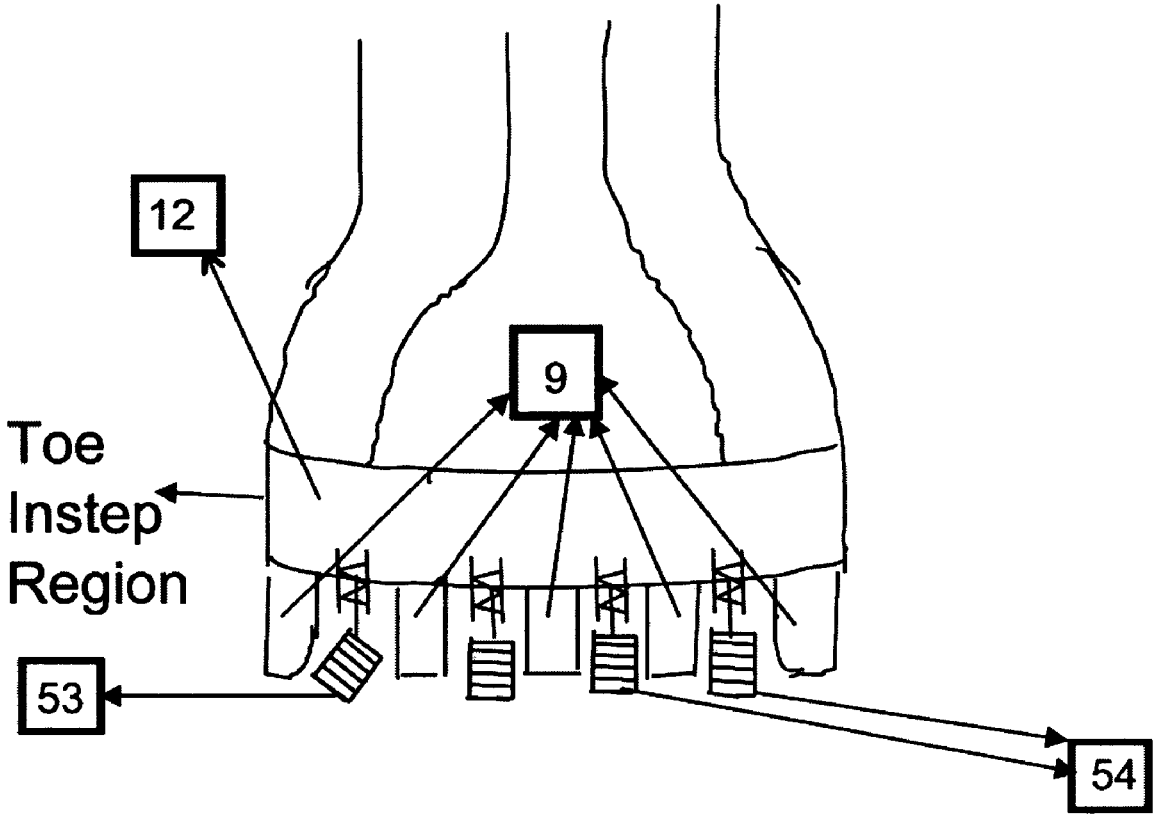
FIG. 13C illustrates a front view of toe section of a shoe with multiple mechanical assemblies with conveyors in a lowered position, along with spring supports to the sole, with only the closest assembly from the instep being twisted by tilting towards the instep in the toe section.

In yet another embodiment, with reference to FIGS. 13A and 13B, there are multiple assemblies of conveyor 42 housed in one sole separated by sidewalls 9. The two outer most conveyors 52, in FIG. 13A, farthest from the instep are twisted. In addition, the inner most conveyor assembly 53, in FIG. 13C, closest to the instep is also twisted. The twist for the two outer most conveyors 52, in FIG. 13A, is such that for each twisted conveyor, the conveyor surface in the heel section 13 in FIG. 13A, only, is tilted away from the instep with respect to the plane of the sole. In the toe section 12, in FIG. 13C, there is no tilt 54, for any conveyor assembly, except for the closest assembly 53, in FIG. 13C, at the instep, and the conveyor surfaces are parallel to the sole at all times. This tilt of the two outer most conveyors 52 in the heel section 13, in FIG. 13A, only, which are away from the instep, allows for a greater contact at the heel section of the conveyor surface with the underlying surface as the shoe initially strikes the underlying surface at the heel section. The conveyor 53, in FIG. 13C, closest to the instep is twisted such that the conveyor surface is tilted, at the toe section 12, in FIG. 13C, only, at an angle with respect to the plane of the sole towards the instep. As the shoe completes its walking action and starts to lift, it creates an angular contact at the toe area 12, in FIG. 13C, towards the instep. As the angle of the tilt for the instep conveyor 53, in FIG. 13C, at the instep is closer to the angle of the angular contact of the sole towards the instep the tilt at the toe area provides for a greater contact of the conveyor surface area with the under lying surface. The conveyor at the instep 53, in FIG. 13C, utilizing this greater contact area contributes more in the forward transportation of the foot than would have been possible with the tilt. The conveyor surface of the instep conveyor 55, in FIG. 13A, is flat at the heel section of the sole at all times. The angle of the tilt for the two outermost conveyors 52, in FIG. 13A, in the heel section only can be such that they each have a different angle of the tilt 57, in FIG. 13B, with the outer most conveyor having the greater angle 56, in FIG. 13B. The two different angles for the conveyors, with the greater angle 56, in FIG. 13B, at the outer most conveyor, provides for greater conveyor surface contact with the underlying surface than is possible if the two outer most conveyors 52, in FIG. 13A, have the same angle for the tilt. Again, the twist of the outer most conveyor assemblies 52, in FIG. 13A, and the twist of the instep conveyor assembly 53, in FIG. 13C, is adjustable mechanically as well as by remote operation.

In yet another embodiment, with reference to FIGS. 13A and 13B, there are multiple assemblies of conveyor 42 housed in one sole separated by sidewalls 9. All the conveyors in both the soles have a spring support 48, in FIGS. 13A and 13B, connected directly to the sole. These spring supports 48, in FIGS. 13A and 13B, have the same function and operation as described before in a previous embodiment in FIGS. 12A and 12B. The two outer most conveyors 52, in FIG. 13A, farthest from the instep are twistable reflexively. In addition, the innermost conveyor assembly 53, in FIG. 13C, closest to the instep is also twistable reflexively. The reflexive twist for the two outer most conveyors 52, in FIG. 13A, is such that for each conveyor, the conveyor surface in the heel section 13 in FIG. 13A, only, reflexively tilts away from the instep with respect to the plane of the sole as the sole initially strikes the underlying surface. This reflexive tilt, for the two outer most conveyors 52, in FIG. 13A, in the heel section, goes away and the tilted conveyor surfaces 52, in FIG. 13A, again become parallel to sole in their entire length from heel to toe, as the foot moves forward in the forward walking action. In the toe section 12, in FIG. 13C, surfaces for all the conveyors are parallel to the sole at all times, except for the closest assembly 53, in FIG. 13C, at the instep. As the shoe strikes the underlying surface at the heel section 13, in FIG. 13A, it creates an angular contact at the heel section at the outermost conveyors 52, in FIG. 13A. The angle of the tilt of the outermost conveyors 52, in FIG. 13A, traces the angle the of the angular contact at the heel section 13, in FIG. 13A, because the conveyor surfaces are to remain parallel to the underlying surface at the angular contact without being parallel to the plane of the sole. This tracing of the angular contact, of the heel section 13, in FIG. 13A, with the underlying surface, allows for a maximum surface contact at the heel section of the conveyors 52, in FIG. 13A, with the underlying surface as the shoe initially strikes the underlying surface. As the tracing of the angular contact goes on the angle of tilt for each of the outermost conveyors 52, in FIG. 13A, in the direction away from the instep, can be different 57, in FIG. 13B. The outermost conveyors 52, in FIG. 13A, utilizing this maximum surface contact area with the underlying surface, contribute more in the forward transportation of the foot than would have been possible without the reflexive tilt. The conveyor 53, in FIG. 13C, closest to the instep also twists reflexively such that the conveyor surface reflexively tilts, at the toe section 12 only in FIG. 13C, at an angle with respect to the plane of the sole towards the instep. As the shoe completes its walking action and starts to lift it creates an angular contact at the toe section 12, in FIG. 13C, towards the instep. As the angle of the of the reflexive tilt for the conveyor 53, in FIG. 13C, at the instep traces the angle of the angular contact of the sole, towards the instep, the reflexive tilt at the toe area provides for a greater contact of the conveyor surface area with the underlying surface. The conveyor at the instep 53, in FIG. 13C, utilizing this greater contact area contributes more in the forward transportation of the foot than would have been possible without the reflexive tilt. The conveyor surface of the instep conveyor 55, in FIGS. 13A and 13B, is flat at the heel section of the sole at all times.

In a further embodiment of the present invention, each sole, housing the conveyor or multiple conveyors, is equipped with two sets of smart sensors, connected to a computer. One set of sensors generates a profile of a pressure pattern of the foot in the course of a normal walking action. The second set of sensors measures the walking speed of the person. The computer in response to the information from the two sets of sensors deduces the intent of the walking person. Hence, if the person while walking is gradually coming to a stop, then in response to the particular pressure pattern and measurement information on the walking speed, the computer, deducing the intent of the walking person, subsequently reduces the identical speed of all conveyors in the sole synchronously. As the computers, housed in each shoe of the pair, are in wireless communication with each other, conveyors housed in both the soles are synchronously slowed to the same speed. The computers on each sole, in wireless communication with each other, ensure that the speed of all the conveyors on both the soles is the same. As the person wearing the shoes, after gradually slowing down, stops, the pair of sole based computers communicating wirelessly with each other and with the two sets of sensors on board the respective soles, stops the conveyors synchronously on both the shoes. This same mechanism allows the respective computers, on each sole, to increase the speed of all the conveyors synchronously, on the respective soles, in response to information on the pressure pattern and the measurement of speed in a case of an increase in walking speed of the person. The respective computer on each sole also operates all electrical and mechanical operations related to the conveyor assembly in the principal embodiment.

DRAWING LEGEND

1. Shoe
2. Sole of the shoe
3. Conveyor
4. Wheels or Rollers
5. Direction for forward conveyor movement
6. Attachment for wheels or rollers to motor
7. Border area for heel
8. Border area for toe
9. Side walls within the sole
10. Assembly at elevated no-contact level
11. Assembly at lowered level
12. Toe section
13. Heel section
14. Instep region
15. Assembly
16. Skew angle balancing outward foot angle
17. Straight line from heel to toe
18. Adjuster for skew angle
19. Angle for forward incline
20. Angular force exerted by foot as is comes down
21. Downward force exerted by foot as is comes down
22. Opposing component of force exerted by the surface
23. A sequence of force exerted by foot as is starts to lift
24. Lifting force on foot while in forward stride.
25. Rising backward incline angle
26. Crumple zone
27. Torque moment arm
28. Sequence of force moving to toe area
29. Final backward incline
30. Force exerted by foot before leaving surface contact
31. Supplementing component of force exerted by surface
32. Spring Support in heel area
33. Fixed Support in heel area
34. Flat conveyor surface in toe area
35. Tilted conveyor in the direction away from instep
36. Tilted conveyor in the direction of instep
37. Support in heel contracting away from instep
38. Support in heel contracting towards instep
39. Front conveyor
40. Rear conveyor
41. Two conveyor assemblies in one housing of sole
42. Multiple conveyor assemblies in one housing of sole
43. Different starting baseline in heel area for multiple assemblies
44. Different endpoints in toe area for multiple assemblies
45. Assembly closest to instep
46. Assembly farthest from instep
47. Central most assemblies
48. Spring supports directly connecting sole with the assembly
49. Farthest assembly from instep, tilting away from instep entirely
50. Farthest assemblies from instep, tilting away from instep entirely at same angle
51. Farthest assembly from instep, tilting away from instep entirely at a greater angle than adjacent assembly
52. Twisted assemblies farthest from instep tilting away from instep at the same angle in heel section only
53. Twisted assembly closest to instep tilting towards instep at toe only
54. Flat assemblies in toe section farthest from instep
55. Flat assembly in heel section closest to instep
56. Outer most assembly farthest from instep, tilting away from instep in heel section only at a greater angle than the adjacent assembly
57. Outer most assemblies farthest from instep, tilting away, at different angles, from the instep in heel section only

What is claimed:

1. A pair of electrically powered motorized shoes such that a sole of each shoe is equipped with at least one motorized means wherein for each time interval when the said means is in contact with an underlying surface each said means provides a supplementary increase in a walking speed of a user when the user is moving forward in a walking action on the said surface in conjunction with and without affecting, the walking action of the user; wherein the walking action of the user wearing the shoes is substantially similar to a walking action of the same user without any shoes such that a sole of each shoe houses, a mechanical assembly comprising of an electrically powered set of wheels or rollers, electric motor means, electro-mechanical means to attach wheels or rollers to the electric motor means to drive the wheels or rollers and electric power storage means wherein the set of wheels and rollers is clasped over by a conveyor that makes an angle towards an instep with a straight line going from heel section to toe section, in a plane parallel to the plane of the sole.

2. A pair of shoes as in claim 1 such that the sole of each shoe housing a mechanical assembly with a conveyor is provided with walls on the border perimeter of the sole, giving cover to the mechanical assembly and conveyor, such that the said shoes with soles, which have these walls as the only contact with an underlying surface, are utilizable for a walking action by a user.

3. A pair of shoes such that the sole of each shoe houses a mechanical assembly with a conveyor as in claim 1 is equipped with mechanical means to elevate and lower the assembly, such that in an elevated position the conveyor is not in contact with an underlying surface, and in a lowered position the said conveyor is the only contact with the underlying surface.

4. A pair of shoes such that the sole of each shoe houses a mechanical assembly with a conveyor as in claim 1 is equipped with electromechanical means to elevate and lower the assembly, such that in an elevated position the conveyor is not in contact with an underlying surface, and in a lowered position the said conveyor is the only contact with the underlying surface.

5. A pair of shoes as in claim 4 wherein the mechanical assemblies are electronically motorized mechanical assemblies such that all electrical and mechanical operations are electronically and remotely controlled.

6. A pair of shoes such that the sole of each shoe houses a mechanical assembly with a conveyor as in claim 1 such that the conveyor is driven by the said mechanical assembly for forward transportation of the user when the said conveyor is in contact with an underlying surface.

7. A pair of shoes such that the sole of each shoe housing a mechanical assembly with conveyor as in claim 6 is equipped with mechanical means to adjust in a plane parallel to the plane of the sole, an angle towards the instep that the conveyor makes with a straight line going from heel section to toe section.

8. A pair of shoes such that the sole of each shoe housing a mechanical assembly with conveyor as in claim 6 is equipped with electromechanical means to adjust in a plane parallel to the plane of the sole, an angle towards the instep that the conveyor makes with a straight line going from heel section to toe section.

9. A pair of shoes as in claim 8 wherein the mechanical assemblies are electronically motorized mechanical assemblies such that all electrical and mechanical operations are electronically and remotely controlled.

10. A pair of shoes such that the sole of each shoe housing a mechanical assembly with conveyor as in claim 6 is equipped with mechanical means to adjust and lock, in a plane parallel to the plane of the sole, an angle towards the instep that the conveyor makes with a straight line going from heel section to toe section.

11. A pair of shoes such that the sole of each shoe housing a mechanical assembly with conveyor as in claim 6 is equipped with electromechanical means to adjust and lock, in a plane parallel to the plane of the sole, an angle towards the instep that the conveyor makes with a straight line going from heel section to toe section.

12. A pair of shoes as in claim 11 wherein the mechanical assemblies are electronically motorized mechanical assemblies such that all electrical and mechanical operations are electronically and remotely controlled.

13. A pair of shoes such that the sole of each shoe housing a mechanical assembly with conveyor as in claim 6 is equipped with supports equipped with shock absorbing, compression and decompression mechanisms in heel section.

14. A pair of shoes such that the sole of each shoe housing a mechanical assembly with conveyor as in claim 6 is equipped with supports equipped with shock absorbing, compression and decompression mechanisms and compression locking mechanism in heel section.

15. A pair of shoes such that the sole of each shoe housing a mechanical assembly with conveyor as in claim 6 is equipped with supports equipped with shock absorbing, compression and decompression mechanisms in toe section.

16. A pair of shoes such that the sole of each shoe housing a mechanical assembly with conveyor as in claim 6 is equipped with supports equipped with shock absorbing, compression and decompression mechanisms as well as compression locking mechanism in toe section.

17. A pair of shoes such that the sole of each shoe housing a mechanical assembly with conveyor as in claim 6 is equipped with supports equipped with shock absorbing, compression and decompression mechanisms in middle section.

18. A pair of shoes such that the sole of each shoe housing a mechanical assembly with conveyor as in claim 6 is equipped with supports equipped with shock absorbing, compression and decompression mechanisms as well as compression locking mechanism in middle section.

19. A pair of shoes such that the sole of each shoe housing a mechanical assembly with conveyor as in claim 6 wherein the presence of the said assemblies does not alter a balance of a standing user when the said mechanical assemblies with conveyors are the only contact with an underlying surface.

20. A pair of shoes such that the sole of each shoe housing a mechanical assembly with conveyor as in claim 6 wherein the presence of the said assemblies does not alter a forward walking action of a user or a balance of a walking user when the said mechanical assemblies with conveyors are the only contact with an underlying surface.

21. A pair of shoes such that the sole of each shoe housing a mechanical assembly with conveyor as in claim 6 provides an increment in a walking speed of a user, when the said mechanical assemblies with conveyors are in contact with an underlying surface in a course of a forward walking action by the user.

22. A pair of shoes such that the sole of each shoe housing a mechanical assembly with conveyor as in claim 6 provides an adjustable increment in a walking speed of a user, when the said mechanical assemblies with conveyors are in contact with an underlying surface in a course of a forward walking action by the user.

23. A pair of shoes such that the sole of each shoe housing a mechanical assembly with conveyor as in claim 6 provides an increment in a walking speed of a user by supplementing the walking speed with a speed of the conveyor, synchronized at all times between the said pair of shoes, when the said mechanical assemblies with conveyors are in contact with an underlying surface in a course of a forward walking action by the user.

24. A pair of shoes such that the sole of each shoe housing a mechanical assembly with conveyor as in claim 6 provides an adjustable increment in a walking speed of a user by supplementing the walking speed with a speed of the conveyor, synchronized at all times between the said pair of shoes, when the said mechanical assemblies with conveyors are in contact with an underlying surface in a course of a forward walking action by the user.

25. A pair of shoes such that the sole of each shoe housing a mechanical assembly with conveyor as in claim 6 providing an increment in a walking speed of a user by supplementing the walking speed with a speed of the conveyor, when the said mechanical assemblies with conveyors are in contact with an underlying surface in a course of a forward walking action by a user, does not alter the walking action or a balance of the user during the said increment of speed.

26. A pair of shoes such that the sole of each shoe housing a mechanical assembly with conveyor as in claim 6 providing a synchronized increment in a walking speed of a user, when the said mechanical assemblies with conveyors are in contact with an underlying surface in a course of a forward walking action by the user, does not alter the walking action or a balance of the user during the said increment of speed.

27. A pair of shoes such that the sole of each shoe housing a mechanical assembly with conveyor as in claim 6 is equipped with supports equipped with shock absorbing, compression and decompression mechanism in the heel section allows each of the mechanical assemblies, in respective sole, to get twisted each time by getting tilted in the heel section only;

wherein the said tilt is such that a plane passing through and parallel to the conveyor surface in the heel section is no longer parallel to the plane of the sole yet parallel to an underlying surface, as the shoe initially strikes the underlying surface in the heel section in a forward walking action; wherein the direction of angle of the said tilt points in the direction of the support that is compressed more than the other, either towards the instep or away from the instep; wherein the magnitude of angle of the said tilt is directly proportional to the difference of lengths between the two compressed supports, at the instep and opposite to the instep; whereby the said tilt in the said twist goes away from the heel section as the said supports decompress and their lengths become equal to each other with the forward walking action.

28. A pair of shoes such that the sole of each shoe housing a mechanical assembly with conveyor as in claim 6 wherein the said assemblies continue to function without loss of speed when each of the assemblies equipped with supports equipped with shock absorbing, compression and decompression mechanism in the heel section allows each of the mechanical assemblies, in respective sole, to get twisted each time by getting tilted in the heel section only; the said tilt is such that a plane passing through and parallel to the conveyor surface in the heel section is no longer parallel to the plane of the sole yet parallel to an underlying surface, as the shoe initially strikes the underlying surface in the heel section in a forward walking action.

29. A pair of shoes such that the sole of each shoe housing a mechanical assembly with conveyor as in claim 6 wherein the said assemblies continue to function, without variation of speed when subjected to recurrent impacts from the underlying surface, at the rear end of the heel section, while walking such that there is a component of force opposing conveyor motion.

30. A pair of shoes such that the sole of each shoe housing a mechanical assembly with conveyor as in claim 6 wherein the said assemblies continue to function, without variation of speed when subjected to a recurrent torque, due to a lifting force as the said shoes lift up from the underlying surface, at the front end of the toe section while walking such that there is a component of force supplementing conveyor motion.

31. A pair of shoes such that the sole of each shoe housing a mechanical assembly with conveyor as in claim 6 wherein the said assemblies continue to function, without variation of speed as each of the assemblies bend, in their respective soles, in a crumple zone as the shoes bend in a forward walking stride; the said crumple zone being a stretch of shoe length in which the shoe bends in its middle section as it staffs to lift up, from an underlying surface, in a stride of forward walking action by a user.

32. A pair of shoes as in claim 14 wherein the mechanical assemblies are electronically motorized mechanical assemblies such that all electrical and mechanical operations are electronically and remotely controlled.

33. A pair of shoes as in claim 16 wherein the mechanical assemblies are electronically motorized mechanical assemblies such that all electrical and mechanical operations are electronically and remotely controlled.

34. A pair of shoes as in claim 18 wherein the mechanical assemblies are electronically motorized mechanical assemblies such that all electrical and mechanical operations are electronically and remotely controlled.

35. A pair of shoes as in claim 22 wherein the mechanical assemblies are electronically motorized mechanical assemblies such that all electrical and mechanical operations are electronically and remotely controlled.

36. A pair of shoes as in claim 23 wherein the mechanical assemblies are electronically motorized mechanical assemblies such that all electrical and mechanical operations are electronically and remotely controlled.

37. A pair of shoes as in claim 24 wherein the mechanical assemblies are electronically motorized mechanical assemblies such that all electrical and mechanical operations are electronically and remotely controlled.

38. A pair of shoes as in claim 6 wherein the mechanical assemblies are electronically motorized mechanical assemblies such that all electrical and mechanical operations are electronically and remotely controlled.

39. A pair of shoes such that the sole of each shoe houses a mechanical assembly as in claim 1 such that each conveyor is synchronous in speed to the other, when driven by the respective mechanical assembly within the respective sole for forward transportation of the user when the said conveyor is in contact with an underlying surface.

40. A pair of shoes as in claim 1 wherein the mechanical assemblies are electronically motorized mechanical assemblies such that all electrical and mechanical operations are electronically and remotely controlled.

41. A pair of shoes as in claim 1 such that the sole of each shoe houses a set of sensors.

42. A pair of shoes as in claim 1 such that the sole of each shoe houses a set of sensors that measures walking speed of a user.

43. A pair of shoes as in claim 1 such that the sole of each shoe houses a set of sensors that generates a profile of a pressure pattern of a foot in a course of a walking action of a user.

44. A pair of shoes as in claim 1 such that the sole of each shoe houses a set of sensors that measures walking speed of a user and a set of sensors that generates a profile of a pressure pattern of a foot in a course of a walking action of a user.

45. A pair of shoes as in claim 1 such that it houses a computer that keeps the speed of the mechanical assemblies on both soles synchronized to be the same.

46. A pair of shoes as in claim 1 such that it houses a computer and each sole of the pair houses sensors and wherein the computer receiving information from the sensors deduces the intent of the user.

47. A pair of shoes as in claim 1 such that it houses a computer and each sole of the pair houses sensors and wherein the computer receiving information from the sensors deduces the intent of the user and synchronously changes the speed of the mechanical assemblies in both the soles.

48. A pair of shoes as in claim 1 such that it houses a computer and each sole of the pair houses sensors and wherein the computer receiving information from the sensors deduces the intent of the user and synchronously decreases the speed of the mechanical assemblies in both the soles.

49. A pair of shoes as in claim 1 such that it houses a computer and each sole of the pair houses sensors and wherein the computer receiving information from the sensors deduces the intent of the user and synchronously increases the speed of the mechanical assemblies in both the soles.

50. A pair of shoes as in claim 1 such that it houses a computer and each sole of the pair houses sensors and wherein the computer receiving information from the sensors deduces the intent of the user and synchronously stops the mechanical assemblies in both the soles.

51. A pair of shoes as in claim 1 such that the sole of each shoe houses a computer wherein the two computers on each sole are in wireless communication with each other.

52. A pair of shoes as in claim 1 such that the sole of each shoe houses a computer wherein the two computers on each sole in wireless communication with each other ensure that the speed of all mechanical assemblies on both the soles is synchronized to be the same.

53. A pair of shoes as in claim 1 such that the sole of each shoe houses a computer wherein the two computers on each sole are in wireless communication and each sole of the pair houses sensors; wherein the computers receiving information from the sensors deduce the intent of the user.

54. A pair of shoes as in claim 1 such that the sole of each shoe houses a computer wherein the two respective computers on each sole are in wireless communication and each sole of the pair houses sensors; wherein the computers receiving information from the sensors deduce the intent of the user and synchronously change the speed of the mechanical assemblies in both the soles.

55. A pair of shoes as in claim 1 wherein the mechanical assemblies are electronically motorized mechanical assemblies such that all electrical and mechanical operations are computer controlled.

* * * * *